US009141030B2

(12) United States Patent
Shimizu et al.

(10) Patent No.: US 9,141,030 B2
(45) Date of Patent: Sep. 22, 2015

(54) IMAGE FORMING SYSTEM INCLUDING A PLURALITY OF TYPES OF DEVELOPING CARTRIDGES AND A PLURALITY OF TYPES OF IMAGE CARRIER CARTRIDGES

(71) Applicant: Brother Kogyo Kabushiki Kaisha, Nagoya-shi, Aichi-ken (JP)

(72) Inventors: Takashi Shimizu, Nagoya (JP); Satoru Ishikawa, Kitanagoya (JP); Tomitake Aratachi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/546,001

(22) Filed: Nov. 18, 2014

(65) Prior Publication Data

US 2015/0139691 A1 May 21, 2015

(30) Foreign Application Priority Data

Nov. 18, 2013 (JP) ..... 2013-238352

(51) Int. Cl.
*G03G 15/08* (2006.01)

(52) U.S. Cl.
CPC .... *G03G 15/0865* (2013.01); *G03G 2221/1853* (2013.01)

(58) Field of Classification Search
CPC ..... G03G 15/0832; G03G 21/1821; G03G 2221/1869; G03G 2221/1853
See application file for complete search history.

(56) References Cited

U.S. PATENT DOCUMENTS

| | | | | |
|---|---|---|---|---|
| 5,911,096 | A | 6/1999 | Batori et al. | |
| 7,406,272 | B2 * | 7/2008 | Nishiyama et al. | 399/12 |
| 7,885,574 | B2 * | 2/2011 | Kamimura | 399/111 |
| 2007/0189781 | A1 * | 8/2007 | Katogi et al. | 399/12 |

FOREIGN PATENT DOCUMENTS

JP H10-228222 A 8/1998

* cited by examiner

*Primary Examiner* — Gregory H Curran
(74) *Attorney, Agent, or Firm* — Banner & Witcoff, Ltd.

(57) ABSTRACT

An image forming system includes: a main casing of an image forming apparatus; a plurality of types of developing cartridges including first and second developing cartridges; and a plurality of types of image carrier cartridges including first and second image carrier cartridges each capable of accommodating selected one of the developing cartridges. The first developing cartridge includes a first cover member. The second developing cartridge includes a second cover member different from the first cover member. The first image carrier cartridge includes a first engaging portion engageable with the first cover member, and a first restriction portion. The second image carrier cartridge includes a second engaging portion engageable with the second cover member. The first restriction portion is configured to restrict the second cover member from engaging the first engaging portion.

10 Claims, 14 Drawing Sheets

11A
17
15
15B
67
63A
64
15A
61A
62
53
51
TOP
LEFT
REAR
FRONT
RIGHT
BOTTOM
56
52
58A
54A
60A
57A
59A
55A
11A
15B
15
51
53
17
TOP
FRONT
LEFT
RIGHT
REAR
BOTTOM

IMAGE FORMING SYSTEM INCLUDING A PLURALITY OF TYPES OF DEVELOPING CARTRIDGES AND A PLURALITY OF TYPES OF IMAGE CARRIER CARTRIDGES

CROSS REFERENCE TO RELATED APPLICATION

This application claims priority from Japanese Patent Application No. 2013-238352 filed Nov. 18, 2013. The entire content of the priority application is incorporated herein by reference.

TECHNICAL FIELD

The present invention relates to an image forming system constituting an image forming apparatus employing an electrophotographic method.

BACKGROUND

Conventionally, there is known an image forming system constituting an image forming apparatus that includes a main casing, and a replacement component that can be mounted in and detached from the main casing.

As such an image forming system described above, there is known a laser beam printer including a main casing, and a process cartridge that is detachably mounted in the main casing. A projecting portion is provided in an access member of the main casing, and a recessed portion into which the projecting portion is fitted is provided in the process cartridge. With this configuration, mounting of a process cartridge that matches with the main casing is permitted by fitting the projecting portion into the recessed portion, while mounting of a process cartridge that does not match with the main casing is restricted by prohibiting the projecting portion from fitting into the recessed portion.

SUMMARY

However, as in the conventional laser beam printer described above, there may be a case where identification of a plurality of types of replacement components is required.

In view of the foregoing, it is an object of the present invention to provide an image forming system capable of identifying types of developing cartridges with a simple configuration.

In order to attain the above and other objects, the present invention provides an image forming system that may include: a main casing of an image forming apparatus; a plurality of types of developing cartridges; and a plurality of types of image carrier cartridges. The plurality of types of developing cartridges may include: a first developing cartridge; and a second developing cartridge different in type from the first developing cartridge. The first developing cartridge may include: a first developer carrier configured to carry a developer thereon and having a first end portion; and a first cover member configured to cover the first end portion. The second developing cartridge may include: a second developer carrier configured to carry a developer thereon and having a second end portion; and a second cover member configured to cover the second end portion. The second cover member may be different from the first cover member. The plurality of types of image carrier cartridges may be each configured to accommodate selected one of the plurality of types of the developing cartridges. The plurality of types of image carrier cartridges may include: a first image carrier cartridge; and a second image carrier cartridge different in type from the first image carrier cartridge. The first image carrier cartridge may include: a first image carrier configured to carry an electrostatic latent image thereon; a first cartridge accommodating portion configured to accommodate the first developing cartridge; a first engaging portion configured to engage the first cover member; and a first restriction portion. The second image carrier cartridge may include: a second image carrier configured to carry an electrostatic latent image thereon; a second cartridge accommodating portion configured to accommodate the second developing cartridge; and a second engaging portion configured to engage the second cover member. The first restriction portion may be configured to restrict the second cover member from engaging the first engaging portion.

DETAILED DESCRIPTION

Figure 1:
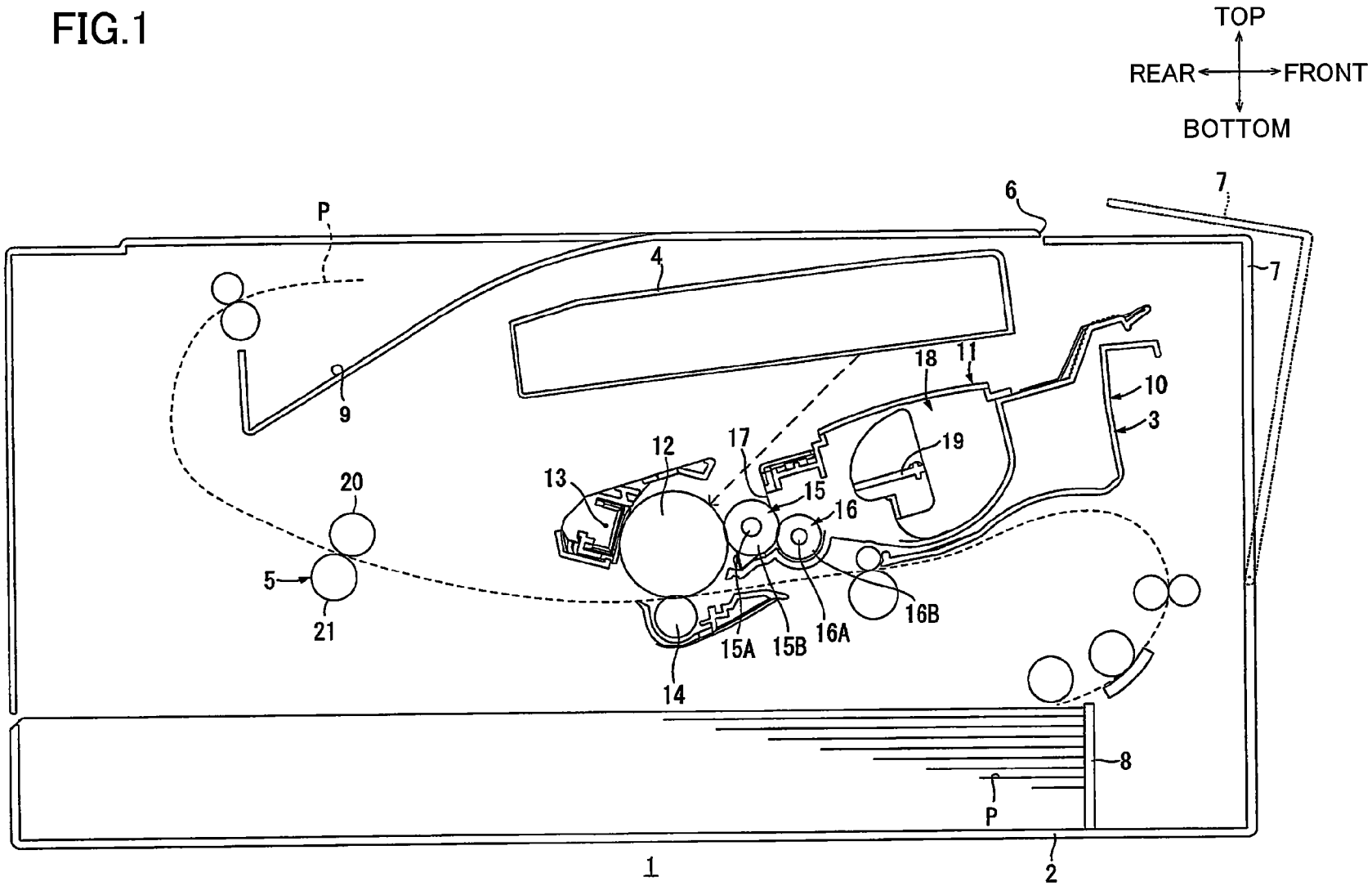
FIG. 1 is a center cross-sectional view of a printer as an image forming apparatus according to one embodiment of the present invention.

1. Overall Structure of Image Forming Apparatus

An image forming apparatus 1 according to one embodiment of the present invention will be described with reference to FIGS. 1 through 14C, wherein like parts and components are designated by the same reference numerals to avoid duplicating description.

The image forming apparatus 1 shown in FIG. 1 is a monochromatic printer employing an electrophotographic method.

In the following description, the terms "upward", "downward", "upper", "lower", "above", "below", "beneath", "right", "left", "front", "rear" and the like will be used assuming that the image forming apparatus 1 is disposed in an orientation in which it is intended to be used. That is, directions related to the image forming apparatus 1 will be given based on a state of the image forming apparatus 1 when the image forming apparatus 1 is resting on a level surface. More specifically, a right side and a left side in FIG. 1 are a front side and a rear side of the image forming apparatus 1, respectively. Further, a right side and a left side of the image forming apparatus 1 will be based on the perspective of a user facing the front side of the image forming apparatus 1. Hence, a near side and a far side in FIG. 1 are the left side and the right side of the image forming apparatus 1, respectively. Further, a top side and a bottom side in FIG. 1 are a top side and a bottom side of the image forming apparatus 1, respectively.

The image forming apparatus 1 includes a main casing 2 as an example of a casing, a process cartridge 3, a scanning unit 4, and a fixing unit 5.

The main casing 2 has a general box-like shape. The main casing 2 has an opening 6. The main casing 2 includes a front cover 7, a sheet supply tray 8, and a sheet discharge tray 9.

The opening 6 is formed in a front end of the main casing 2. The opening 6 communicates with an interior and an exterior of the main casing 2 in a front-rear direction to allow passage of the process cartridge 3.

The front cover 7 is provided at the front end of the main casing 2. The front cover 7 has a general plate-like shape. The front cover 7 extends vertically. The front cover 7 is supported to a front wall of the main casing 2 so as to be pivotally movable about its lower end portion between an open position for opening the opening 6, and a closed position for closing the opening 6.

The sheet supply tray 8 is provided at a bottom portion of the main casing 2. The sheet supply tray 8 is configured to accommodate sheets P of paper.

The sheet discharge tray 9 is provided at a top wall of the main casing 2. The sheet discharge tray 9 is recessed downward form an upper surface of the main casing 2 so as to receive the sheets P thereon.

The process cartridge 3 is accommodated in the main casing 2 at a substantially vertical center portion thereof. The process cartridge 3 is configured to be attached to and detached from the main casing 2 through the opening 6. The process cartridge 3 includes a drum cartridge 10 as an example of an image carrier cartridge, and a developing cartridge 11.

The drum cartridge 10 includes a photosensitive drum 12 as an example of a first or second image carrier, a scorotron charger 13, and a transfer roller 14.

The photosensitive drum 12 is rotatably supported in a rear end portion of the drum cartridge 10. The photosensitive drum 12 has a general cylindrical shape oriented with its axis in a left-right direction.

The scorotron charger 13 is positioned on an upper rear side of the photosensitive drum 12 while being spaced apart therefrom.

The transfer roller 14 is positioned below the photosensitive drum 12. The transfer roller 14 contacts a lower edge of the photosensitive drum 12.

The developing cartridge 11 is mounted in the drum cartridge 10 at a position in front of the photosensitive drum 12. The developing cartridge 11 includes a developing roller 15 as an example of a first or second developer carrier, a supply roller 16, a layer thickness regulation blade 17, and a toner accommodation portion 18.

The developing roller 15 is rotatably supported in a rear end portion of the developing cartridge 11. The developing roller 15 includes a developing roller shaft 15A as an example of a first or second rotation shaft and a developing roller body 15B.

The developing roller shaft 15A has a general cylindrical shape. The developing roller shaft 15A extends in the left-right direction. The developing roller shaft 15A is made of metal.

The developing roller body 15B is a general cylindrical shape. The developing roller body 15B extends in the left-right direction. The developing roller body 15B is made of rubber having electrically conductive properties. The developing roller body 15B covers a generally left-right intermediate portion of the developing roller shaft 15A, while left-right end portions of the developing roller shaft 15A are exposed. The developing roller body 15B contacts a front edge of the photosensitive drum 12.

The supply roller 16 is disposed on a lower front side of the developing roller 15. The supply roller 16 is rotatably supported to the developing cartridge 11. The supply roller 16 includes a supply roller shaft 16A and a supply roller body 16B.

The supply roller shaft 16A has a general cylindrical shape. The supply roller shaft 16A extends in a left-right direction. The supply roller shaft 16A is made of metal.

The supply roller body 16B has a general cylindrical shape. The supply roller body 16B extends in the left-right direction. The supply roller body 16B is made of sponge having electrically conductive properties. The supply roller body 16B covers a generally left-right intermediate portion of the supply roller shaft 16A, while left-right end portions of the supply roller shaft 16A are exposed. The supply roller body 16B contacts a lower front edge of the developing roller body 15B.

The layer thickness regulation blade 17 is positioned above and frontward of the developing roller 15. The layer thickness regulation blade 17 contacts a front edge of the developing roller 15.

The toner accommodation portion 18 is positioned in front of the supply roller 16 and the layer thickness regulation blade 17. The toner accommodation portion 18 is configured to accommodate toner as an example of a developer therein. The toner accommodation portion 18 includes an agitator 19.

The agitator 19 is rotatably supported in the toner accommodation portion 18.

The scanning unit 4 is disposed above the process cartridge 3. The scanning unit 4 is adapted to irradiate a laser beam based on image data toward the photosensitive drum 12, as indicated by a dashed line in FIG. 1.

The fixing unit 5 is disposed rearward of the process cartridge 3. The fixing unit 5 includes a heating roller 20, and a pressure roller 21 that contacts a lower rear edge of the heating roller 20 with pressure.

When the image forming apparatus 1 starts an image-forming operation, the scorotron charger 13 applies a uniform charge to the surface of the photosensitive drum 12. Subsequently, the scanning unit 4 exposes the charged surface of the photosensitive drum 12 to the laser beam, thereby forming an electrostatic latent image on the surface of the photosensitive drum 12 based on the image data.

In the meantime, the agitator 19 agitates toner accommodated in the toner accommodation portion 18 to supply the toner to the supply roller 16. The supply roller 16 supplies the toner supplied by the agitator 19 to the developing roller 15. At this time, the toner is positively tribocharged between the developing roller 15 and the supply roller 16, and the layer thickness regulation blade 17 regulates the thickness of the toner carried on the developing roller 15 so as to maintain the toner on the developing roller 15 at a thin uniform thickness.

Next, the toner carried on the developing roller 15 is supplied to the electrostatic latent image formed on the surface of the photosensitive drum 12, producing a toner image as an example of a developer image on the surface of the photosensitive drum 12.

Various rollers in the image forming apparatus 1 rotate to convey the sheets P from the sheet supply tray 8, and supply the sheets P one sheet at a time between the photosensitive drum 12 and the transfer roller 14 at a prescribed timing. As the sheet P passes between the photosensitive drum 12 and the transfer roller 14, the toner image on the surface of the photosensitive drum 12 is transferred onto the sheet P.

The heating roller 20 and the pressure roller 21 subsequently apply heat and pressure to the sheet P as the sheet P passes therebetween. At this time, the toner image is thermally fixed to the sheet P. Subsequently, the sheet P is discharged onto the sheet discharge tray 9.

2. Process Cartridge

For the drum cartridge 10 described above, a plurality of types of the drum cartridges 10 are prepared based on charging characteristics of the photosensitive drum 12 and the like.

Further, for the developing cartridge 11 described above, a plurality of types of the developing cartridges 11 are prepared based on charging characteristics of the developing roller 15, an amount of toner accommodated in the toner accommodation portion 18, and the like.

An appropriate combination is set between one of the plurality of types of the drum cartridges 10 and one of the plurality of types of the developing cartridges 11 based on the charging characteristics of the photosensitive drum 12 and the developing roller 15, for example.

The image forming apparatus 1 described above is configured by selectively mounting, in the main casing 2, one matching type of the drum cartridge 10 and the developing cartridge 11 among the plurality of types of the drum cartridges 10 and the plurality of types of the developing cartridges 11. That is, the plurality of types of the drum cartridges 10 and the plurality of types of the developing cartridges 11 constitute the image forming system together with the main casing 2.

(1) First Process Cartridge

Figure 2A:
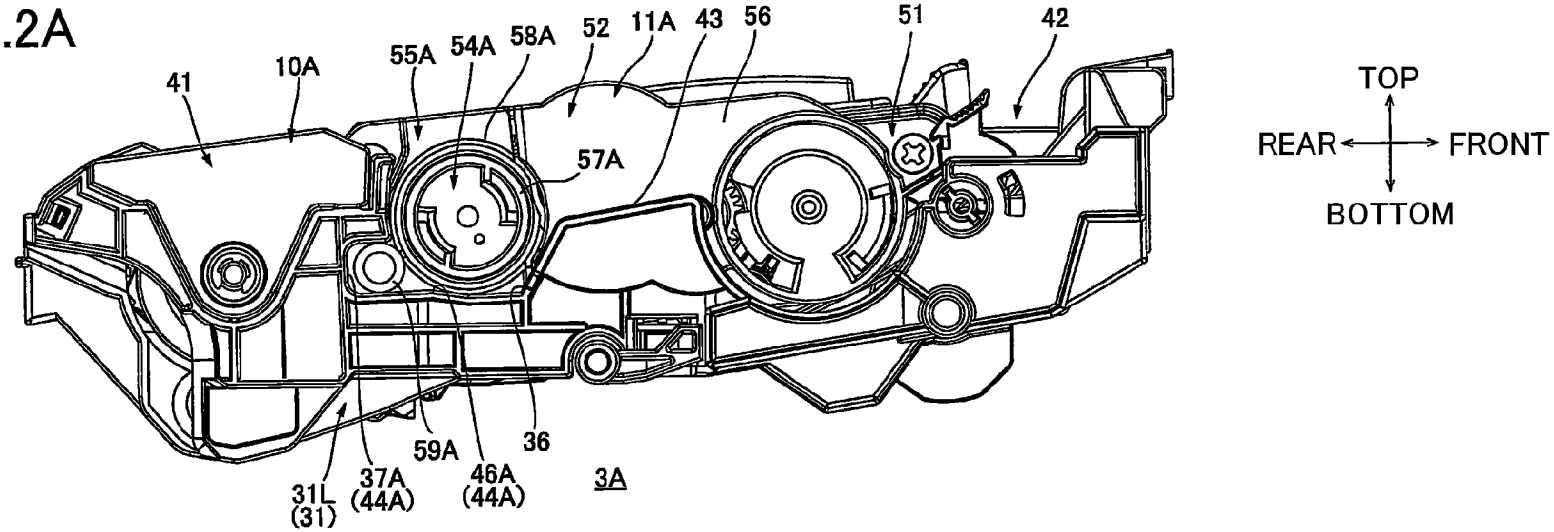
FIG. 2A is a left side view of a first process cartridge.
Figure 2B:
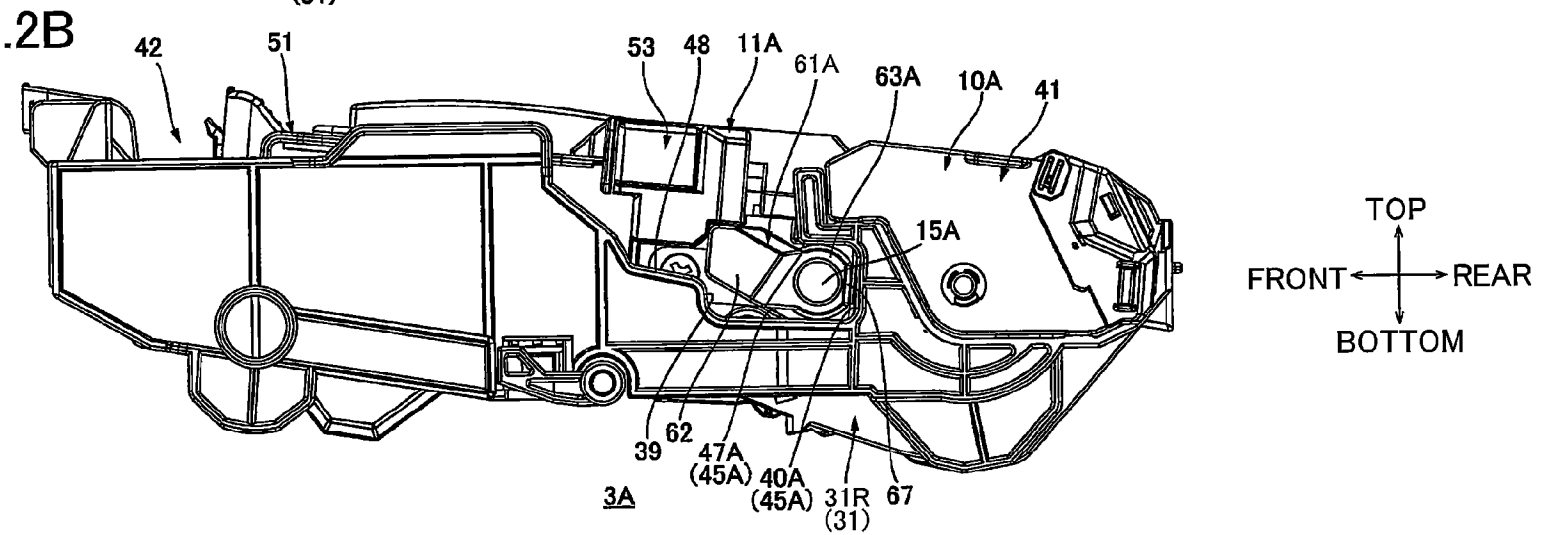
FIG. 2B is a right side view of the first process cartridge in FIG. 2A.

As shown in FIGS. 2A and 2B, a first process cartridge 3A includes a first drum cartridge 10A as an example of a first image carrier cartridge and a first developing cartridge 11A as an example of a first developing cartridge.

(1-1) First Drum Cartridge

Figure 3:
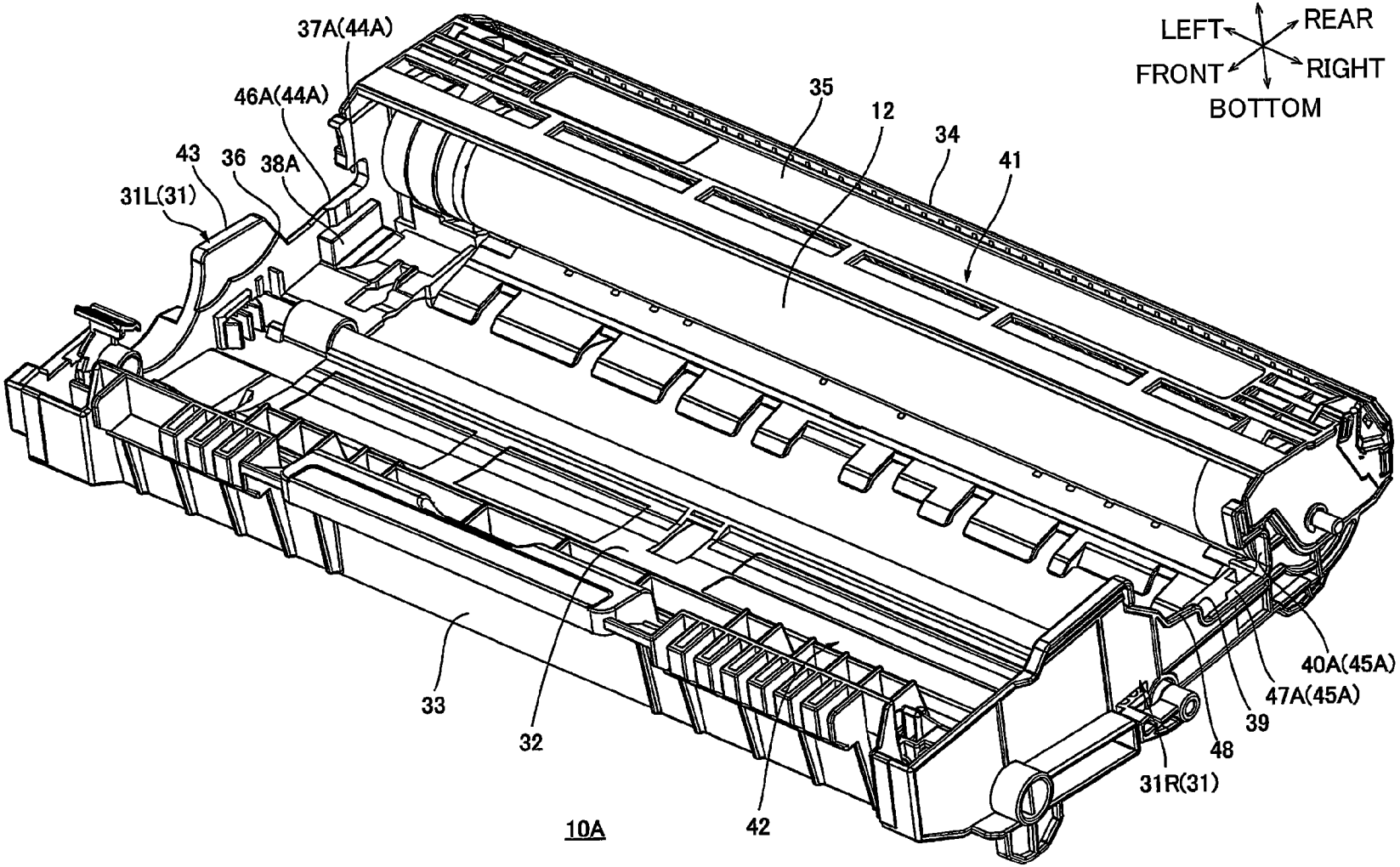
FIG. 3 is a perspective view of a first drum cartridge in FIG. 2A as viewed from an upper front side thereof.

As shown in FIG. 3, the first drum cartridge 10A has a closed-bottom frame shape that is substantially rectangular in a plan view. The first drum cartridge 10A includes a pair of side walls 31, a bottom wall 32, a rear wall 34, a front wall 33, and a top wall 35 in an integral manner.

The pair of side walls 31 constitute left-right ends of the first drum cartridge 10A. Hereinafter, the side wall 31 constituting the left end of the first drum cartridge 10A will be referred to as a left side wall 31L, and the side wall 31 constituting the right end of the first drum cartridge 10A will be referred to as a right side wall 31R when it is necessary to distinguish between the two.

The side walls 31 have a flat plate shape that is substantially rectangular in a side view. The side walls 31 extend in a front-rear direction. The left side wall 31L includes a coupling receiving portion 36 and an interference portion 38A as an example of an interference portion. The right side wall 31R includes an electrode receiving portion 39.

The coupling receiving portion 36 is disposed at a substantial front-rear center portion of the left side wall 31L. The coupling receiving portion 36 has a substantially U-shape in a side view that is recessed downward from an upper edge of the left side wall 31L and has an upper opening. The coupling receiving portion 36 includes a first guide portion 44A and a projecting wall 43.

The first guide portion 44A is disposed at a lower end portion of the coupling receiving portion 36. The first guide portion 44A includes a left collar receiving portion 37A as an example of a first restriction portion or a first engaging portion, and a first guide surface 46A.

The left collar receiving portion 37A is disposed in a lower rear end portion of the coupling receiving portion 36. The left collar receiving portion 37A has a substantially U-shape in a side view that is recessed rearward and has a front opening.

The first guide surface 46A has a substantially linear shape that extends frontward continuously from a front end portion of a lower edge of the left collar receiving portion 37A.

The projecting wall 43 has a flat plate shape that is substantially rectangular in a side view that projects upward from a front end of the first guide surface 46A.

The interference portion 38A is disposed below the left collar receiving portion 37A and the first guide surface 46A. The interference portion 38A has a substantially prismatic shape that projects rightward from a right surface of the left side wall 31L. A rear end portion of the interference portion 38A is positioned below the left collar receiving portion 37A. A front end portion of the interference portion 38A is positioned below a substantial front-rear center portion of the first guide surface 46A.

The electrode receiving portion 39 is disposed at a substantial front-rear center portion of the right side wall 31R. The electrode receiving portion 39 has a substantially U-shape in a side view that is recessed downward from an upper edge of the right side wall 31R and has an upper opening. The electrode receiving portion 39 includes a second guide portion 45A and a stepped portion 48.

The second guide portion 45A is disposed at a lower end portion of the electrode receiving portion 39. The second guide portion 45A includes a right collar receiving portion 40A as an example of a first engaging portion, and a second guide surface 47A.

The right collar receiving portion 40A is disposed in a lower rear end portion of the electrode receiving portion 39. The right collar receiving portion 40A has a substantially U-shape in a side view that is recessed rearward and has a front opening. A vertical inner dimension of the right collar receiving portion 40A is greater than a vertical inner dimension of the left collar receiving portion 37A. An inner rear surface of the right collar receiving portion 40A overlaps an inner rear surface of the left collar receiving portion 37A when projected in the left-right direction.

The second guide surface 47A has a substantially linear shape that extends frontward continuously from a front end portion of a lower edge of the right collar receiving portion 40A.

The stepped portion 48 extends frontward and upward continuously from a front end of the second guide surface 47A while being bent.

The bottom wall 32 spans between lower end portions of the side walls 31, and extends in the front-rear direction. The bottom wall 32 has a flat plate shape that is substantially rectangular in a plan view.

The rear wall 34 has a flat plate shape that projects upward from a rear end of the bottom wall 32 and extends in the left-right direction.

The front wall 33 continuously extends upward from a front end of the bottom wall 32. The front wall 33 has a flat plate shape that is substantially rectangular in a front view. Both of left and right ends of the front wall 33 are respectively continuous to front ends of the side walls 31.

The top wall 35 constitutes an upper rear end portion of the first drum cartridge 10A in a manner covering the photosensitive drum 12. The top wall 35 supports the scorotron charger 13.

In the first drum cartridge 10A, a portion having a substantially box shape defined by the top wall 35, the pair of side walls 31, and a rear end portion of the bottom wall 32 constitutes a drum support portion 41. The photosensitive drum 12 is supported in the drum support portion 41.

A portion defined by a front end of the top wall 35, the pair of side walls 31, and the front wall 33 and positioned frontward of the top wall 35 constitutes a developing-cartridge accommodating portion 42 as an example of a first or second cartridge accommodating portion in which the developing cartridge 11 is accommodated.

(1-2) First Developing Cartridge

Figures 4A, 4B:
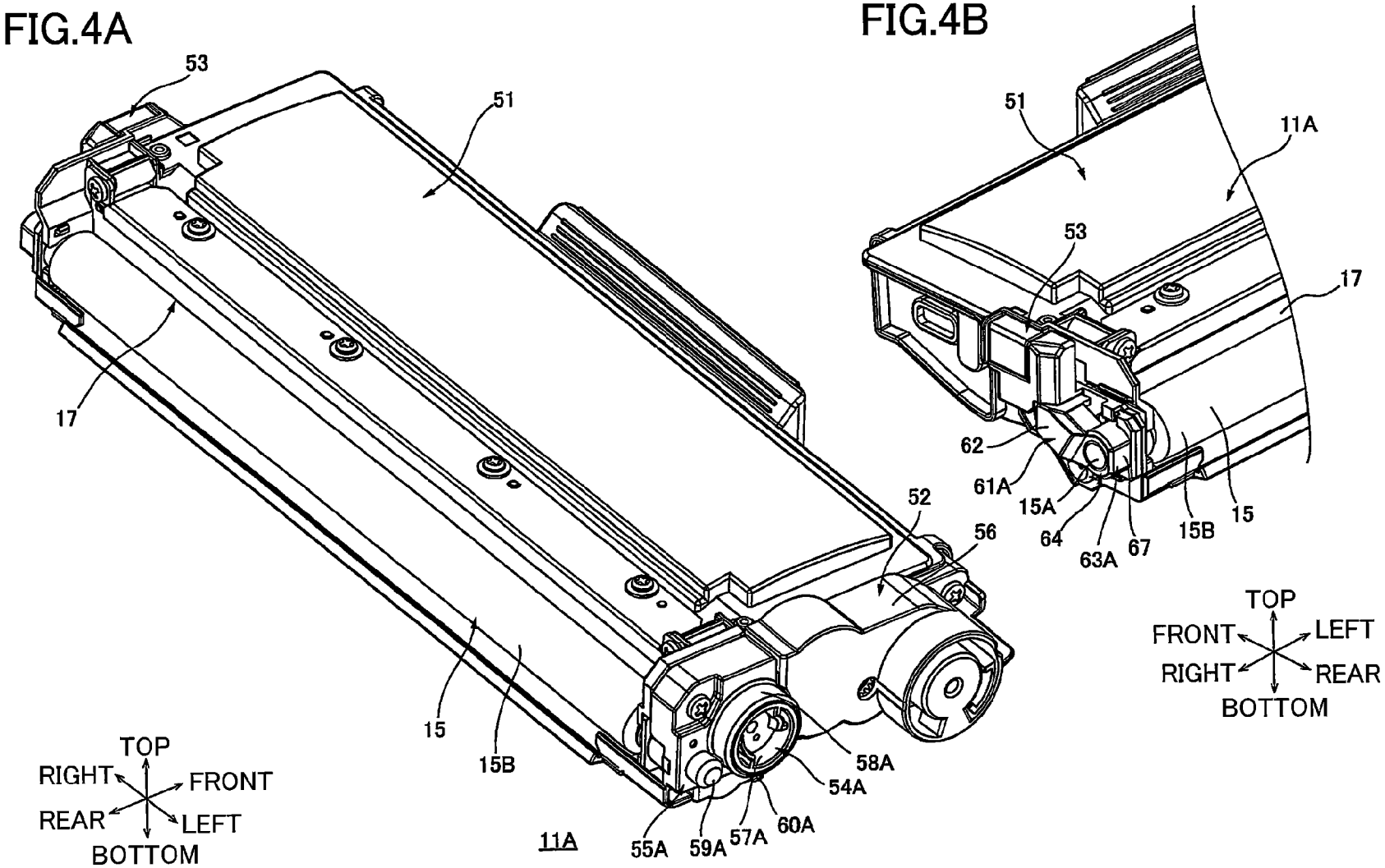
FIG. 4A is a perspective view of a first developing cartridge in FIG. 2A as viewed from an upper left side thereof.
FIG. 4B is a perspective view of the first developing cartridge in FIG. 4A as viewed from an upper right side thereof.

As shown in FIG. 4A, the first developing cartridge 11A includes a developing frame 51, a drive portion 52, and a power supply portion 53.

The developing frame 51 has a box shape that is substantially rectangular in a side view and has a rear opening. The developing frame 51 supports the developing roller 15, the supply roller 16, and the layer thickness regulation blade 17, and includes the toner accommodation portion 18.

The drive portion 52 is supported in a left end portion of the developing frame 51. The drive portion 52 includes a developing coupling 54A as an example of a first receiving member, a first cover 55A, and a second cover 56.

The developing coupling 54A is disposed at a front end portion of the drive portion 52. The developing coupling 54A has a substantially cylindrical shape that extends in the left-right direction. The developing coupling 54A has gear teeth (not shown) at its right end, and is connected to the developing roller shaft 15A, the supply roller shaft 16A, and the agitator 19 so as to be capable of transmitting a drive force thereto through a gear train (not shown). The developing coupling 54A includes a coupling portion 57A.

The coupling portion 57A is disposed at a left end portion of the developing coupling MA. The coupling portion 57A has a substantially cylindrical shape that extends in the left-right direction. The coupling portion 57A is fitted with a coupling (not shown) provided in the main casing 2 so as to be capable of receiving a drive force therefrom.

Figure 5A:
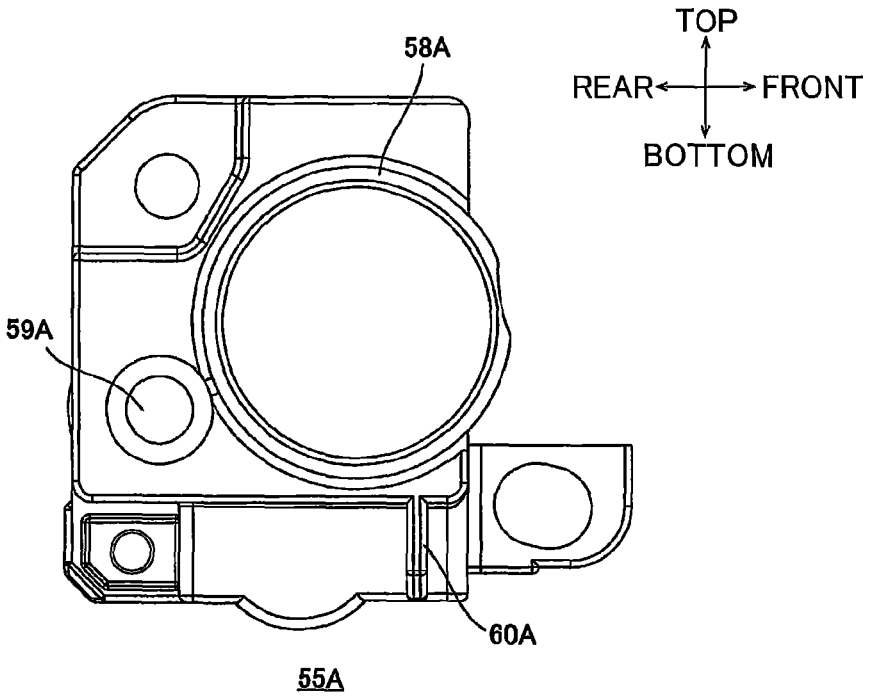
FIG. 5A is a left side view of a first cover in FIG. 4A.
Figure 5B:
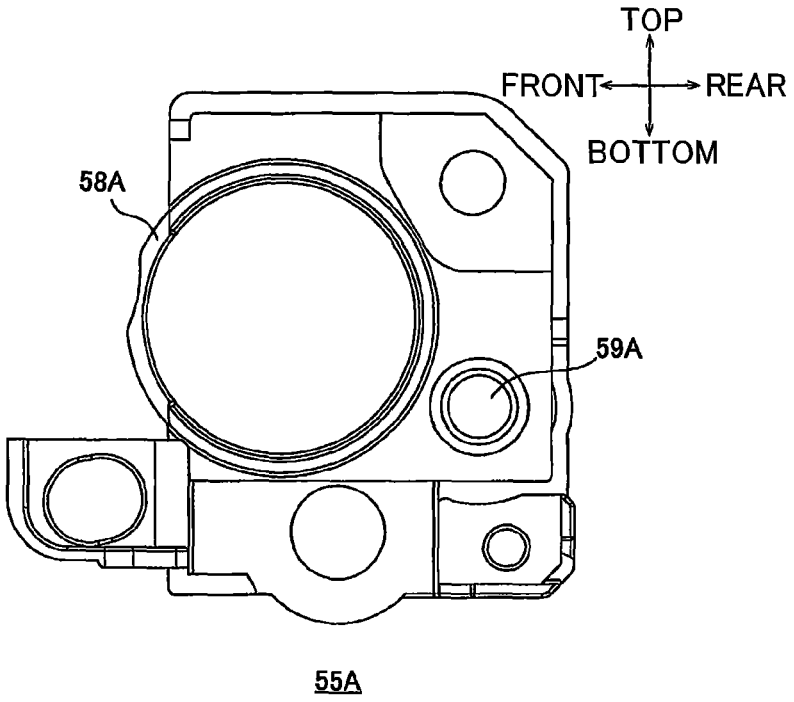
FIG. 5B is a right side view of the first cover in FIG. 5A.

As shown in FIGS. 4A, 5A, and 5B, the first cover 55A is disposed at a rear end portion of the drive portion 52. The first cover 55A has a substantially prismatic shape that extends in the left-right direction and is closed on a left end thereof. The first cover 55A covers the gear train (not shown) that connects the developing coupling 54A, the developing roller shaft 15A and the supply roller shaft 16A. The first cover 55A includes a coupling collar 58A, a developing roller shaft collar 59A as an example of a first cover member, and a rib 60A as an example of a projecting portion.

The coupling collar 58A is disposed at a center portion of the first cover 55A. The coupling collar 58A has a substantially cylindrical shape that extends in the left-right direction. An inner diameter of the coupling collar 58A is substantially equal to an outer diameter of the coupling portion 57A of the developing coupling 54A. The coupling collar 58A is fitted with the coupling portion 57A of the developing coupling 54A.

The developing roller shaft collar 59A is disposed diagonally below and rearward of the coupling collar 58A. The developing roller shaft collar 59A has a substantially cylindrical shape that extends in the left-right direction and is closed on a left end thereof. An outer diameter of the developing roller shaft collar 59A is substantially equal to the vertical inner dimension of the left collar receiving portion 37A of the first drum cartridge 10A. An inner diameter of the developing roller shaft collar 59A is substantially equal to an outer diameter of a left end portion of the developing roller shaft 15A. The developing roller shaft collar 59A is fitted with the left end portion of the developing roller shaft 15A.

The rib 60A is disposed at a front end portion of the first cover 55A and below a front end portion of the coupling collar 58A. The rib 60A has a substantially flat plate shape that projects leftward from a left surface of the first cover 55A and extends in the vertical direction.

The second cover 56 is disposed in front of the first cover 55A. The second cover 56 has a substantially prismatic shape that extends in the left-right direction and is closed on a left end thereof. The second cover 56 covers the gear train (not shown) that connects the developing coupling 54A and the agitator 19.

As shown in FIG. 4B, the power supply portion 53 is supported in a right end portion of the developing frame 51 at its rear end portion thereof. The power supply portion 53 includes a developing electrode 61A.

Figure 6A:
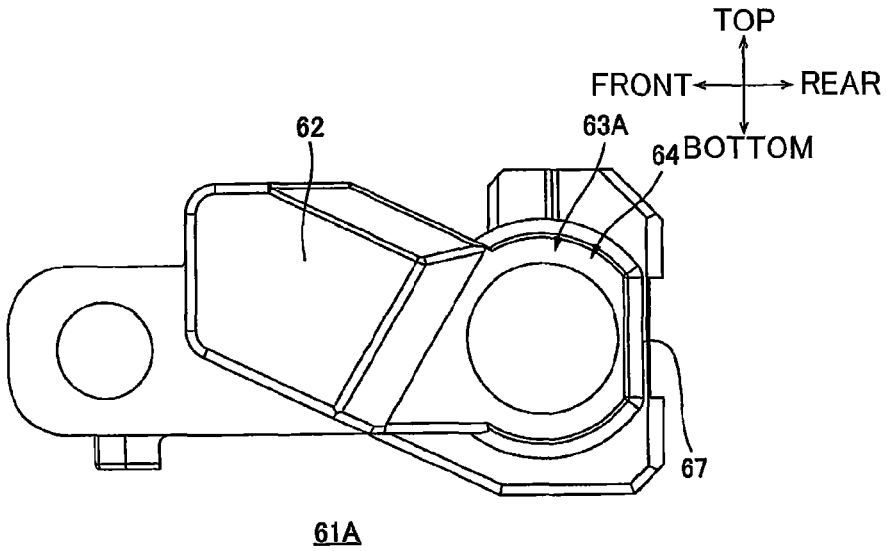
FIG. 6A is a right side view of a developing electrode in FIG. 4B.
Figure 6B:
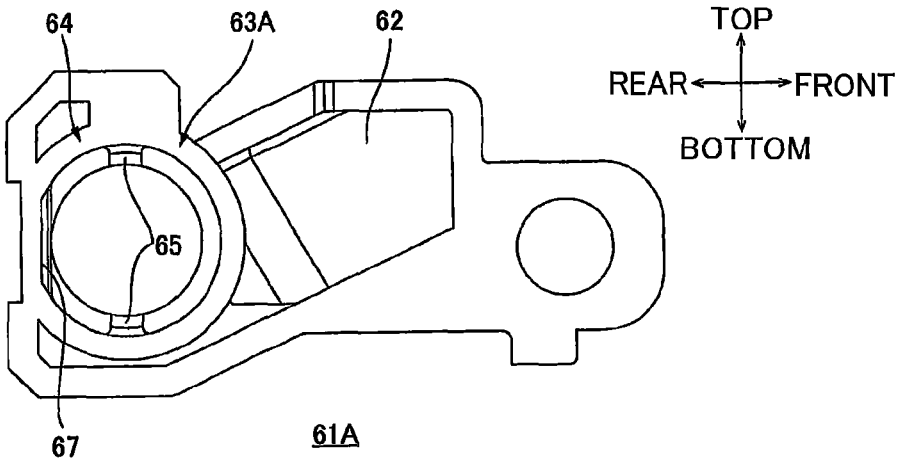
FIG. 6B is a left side view of the developing electrode in FIG. 6A.

As shown in FIGS. 4B, 6A, and 6B, the developing electrode 61A is supported in a lower rear end portion of the power supply portion 53 (developing frame 51). The developing electrode 61A has a substantially prismatic shape that extends in the front-rear direction. The developing electrode 61A is adapted to supply an electric power from the main casing 2 to the developing roller shaft 15A. The developing electrode 61A is made from electrically-conductive resin. The developing electrode 61A includes a contact portion 62, and a developing roller shaft collar 63A as an example of a first cover member.

The contact portion 62 is disposed at a front half of the developing electrode 61A. The contact portion 62 has a substantially prismatic shape that extends in the left-right direction and is closed on a right end thereof. The contact portion 62 is adapted to receive an electric power by contacting an electrode (not shown) provided in the main casing 2.

The developing roller shaft collar 63A is disposed at a rear half of the developing electrode 61A. The developing roller shaft collar 63A has a substantially cylindrical shape that extends in the left-right direction. The developing roller shaft collar 63A is fitted with a right end portion of the developing roller shaft 15A. The developing roller shaft collar 63A includes an enclosing portion 64 and a pair of abutting portions 65.

The enclosing portion 64 constitutes an outer shape of the developing roller shaft collar 63A, and has a substantially cylindrical shape that extends in the left-right direction. A rear end 67 of the enclosing portion 64 is cut out in a manner extending linearly in the vertical direction. An outer diameter of the enclosing portion 64 is greater than the outer diameter of the developing roller shaft collar 59A of the first cover 55A, and substantially equal to the vertical inner dimension of the right collar receiving portion 40A of the first drum cartridge 10A. An inner diameter of the enclosing portion 64 is greater than an outer diameter of the right end portion of the developing roller shaft 15A.

The abutting portions 65 have a substantially rectangular shape in a side view that extends in the vertical direction, and project inward in a radial direction of the enclosing portion 64 from upper and lower inner circumferential surfaces of the enclosing portion 64. A vertical distance between the abutting portions 65 is substantially equal to the outer diameter of the right end portion of the developing roller shaft 15A. Radially inner ends of the abutting portions 65 contact the developing roller shaft 15A. The abutting portions 65 are adapted to supply an electric power received by the contact portion 62 to the developing roller shaft 15A.

(2) Second Process Cartridge

Figure 7A:
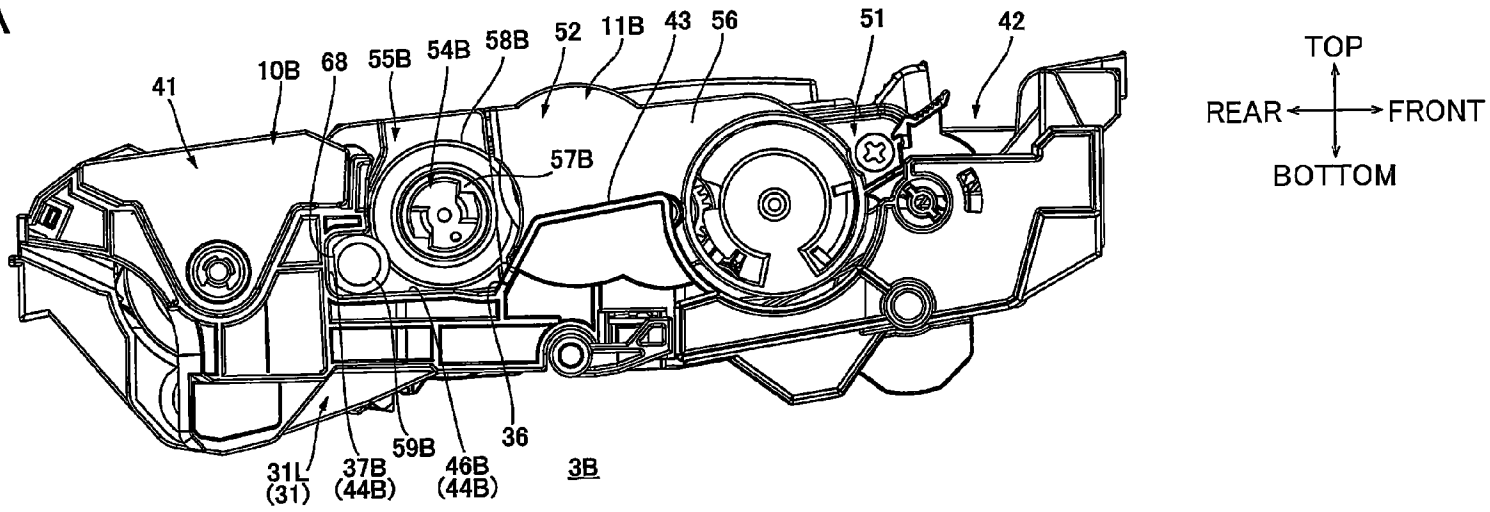
FIG. 7A is a left side view of a second process cartridge.
Figure 7B:
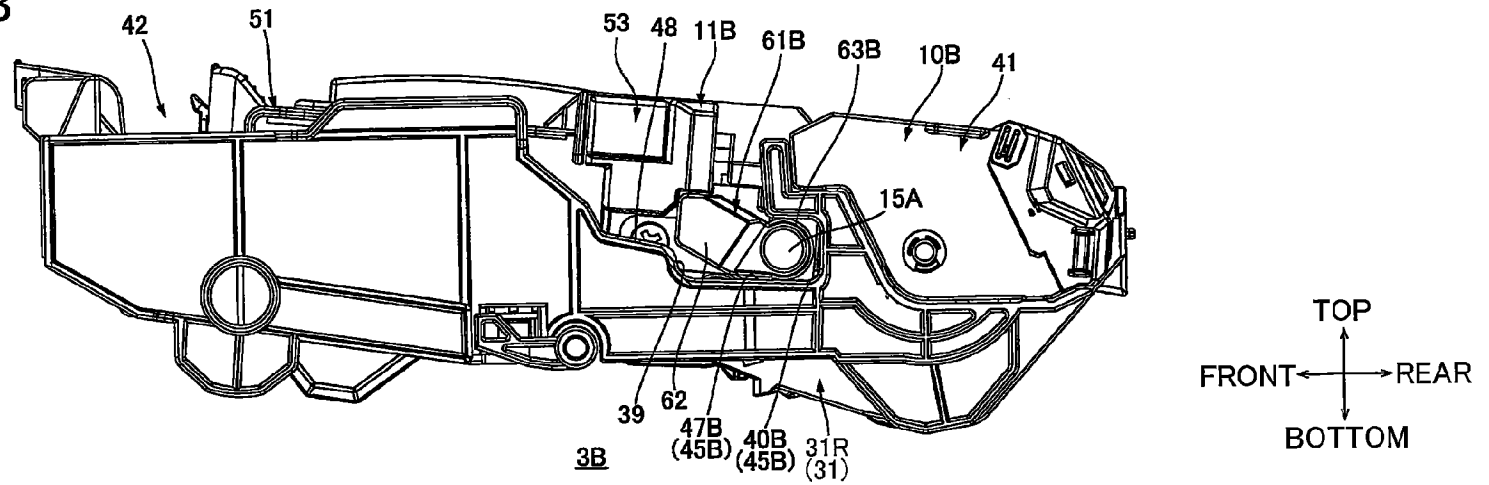
FIG. 7B is a right side view of the second process cartridge in FIG. 7A.

As shown in FIGS. 7A and 7B, a second process cartridge 3B includes a second drum cartridge 10B as an example of a second image carrier cartridge, and a second developing cartridge 11B as an example of a second developing cartridge.

(2-1) Second Drum Cartridge

Figure 8:
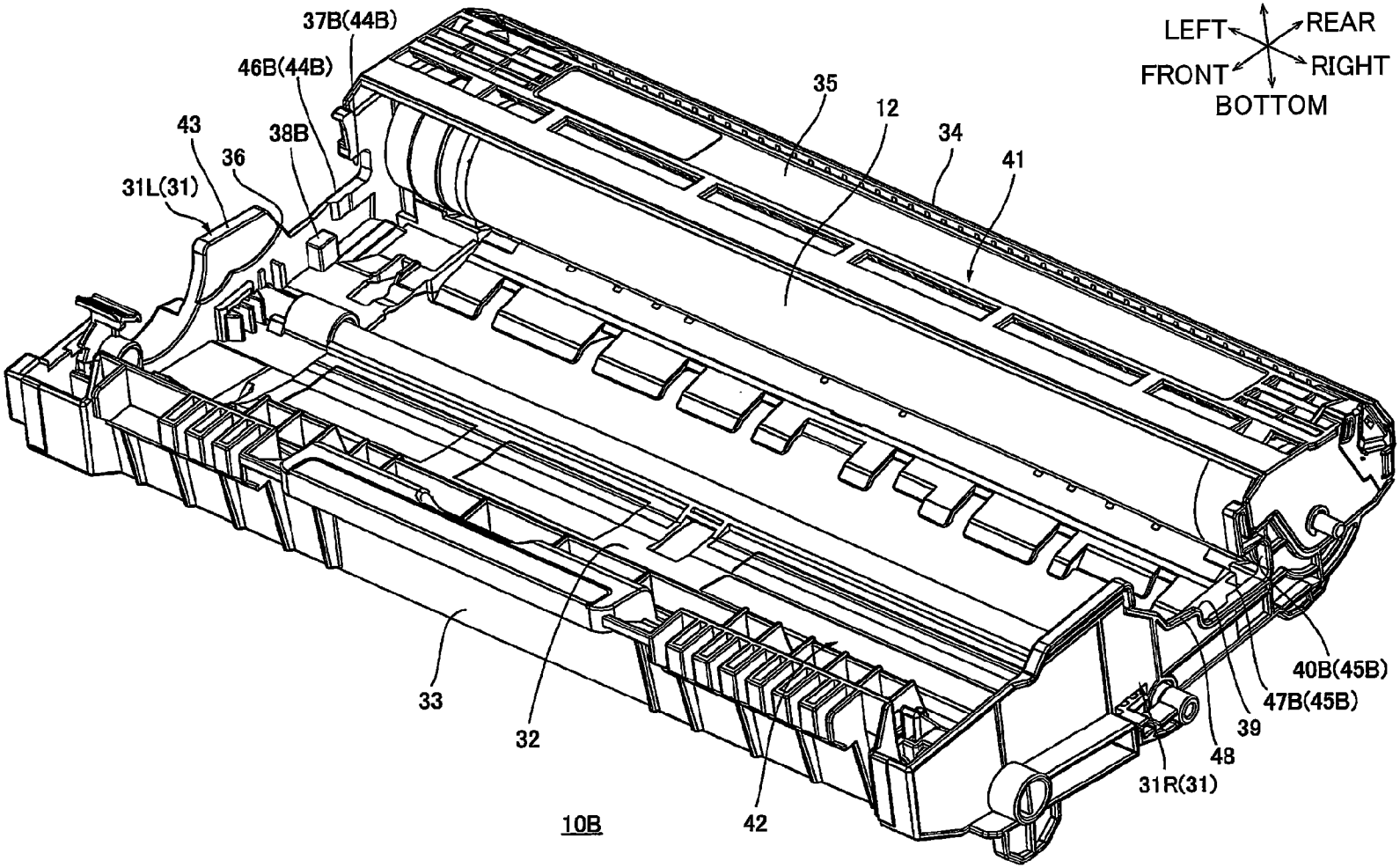
FIG. 8 is a perspective view of a second drum cartridge in FIG. 7A as viewed from an upper front side thereof.

As shown in FIG. 8, the second drum cartridge 10B is configured in a similar manner to the first drum cartridge 10A, except that the second drum cartridge 10B includes a first guide portion 44B different from the first guide portion 44A of the first drum cartridge 10A, an interference portion 38B different from the interference portion 38A of the first drum cartridge 10A, and a second guide portion 45B different from the second guide portion 45A of the first drum cartridge 10A.

The first guide portion 44B includes a left collar receiving portion 37B as an example of a second engaging portion and a first guide surface 46B.

The left collar receiving portion 37B is disposed at a lower rear end portion of the coupling receiving portion 36. The left collar receiving portion 37B has a substantially U-shape in a side view that is recessed rearward and has a front opening. A vertical inner dimension of the left collar receiving portion 37B is greater than the vertical inner dimension of the left collar receiving portion 37A of the first drum cartridge 10A.

The first guide surface 46B has a substantially linear shape that extends frontward continuously from a front end portion of a lower edge of the left collar receiving portion 37B.

The interference portion 38B as an example of an interference portion is disposed below a front half of the first guide portion 44B. The interference portion 38B has a substantially prismatic shape that projects rightward from the right surface of the left side wall 31L. A front-rear length of the interference portion 38B is smaller than a front-rear length of the interference portion 38A of the first drum cartridge 10A. A rear end of the interference portion 38B is positioned below a substantial front-rear center of the first guide surface 46B. A front end of the interference portion 38B is positioned below a front edge of the first guide surface 46B.

The second guide portion 45B is configured in a similar manner to the second guide portion 45A of the first drum cartridge 10A, except that the second guide portion 45B includes a right collar receiving portion 40B as an example of a second restriction portion or a second engaging portion different from the right collar receiving portion 40A of the first drum cartridge 10A. The second guide portion 45B includes the right collar receiving portion 40B and a second guide surface 47B.

The right collar receiving portion 40B is disposed at a lower rear end portion of the electrode receiving portion 39. The right collar receiving portion 40B has a substantially U-shape in a side view that is recessed rearward and has a front opening. A vertical inner dimension of the right collar receiving portion 40B is substantially equal to the vertical inner dimension of the left collar receiving portion 37B. The vertical inner dimension of the right collar receiving portion 40B is smaller than the vertical inner dimension of the right collar receiving portion 40A of the first drum cartridge 10A. An inner rear surface of the right collar receiving portion 40B overlaps an inner rear surface of the left collar receiving portion 37B when projected in the left-right direction.

The second guide surface 47B has a substantially linear shape that extends frontward continuously from a front end portion of a lower edge of the right collar receiving portion 40B.

(2-2) Second Developing Cartridge

As shown in FIGS. 7A and 7B, the second developing cartridge 11B is configured in a similar manner to the first developing cartridge 11A, except that the second developing cartridge 11B includes a developing coupling 54B as an example of a second receiving member different from the developing coupling 54A of the first developing cartridge 11A, a first cover 55B different from the first cover 55A of the first developing cartridge 11A, and a developing electrode 61B different from the developing electrode 61A of the first developing cartridge 11A.

The developing coupling 54B is configured in a similar manner to the developing coupling MA of the first developing cartridge 11A, except that a shape of a coupling portion 57B is different from the coupling portion 57A of the first developing cartridge 11A.

The coupling portion 57B is disposed at a left end portion of the developing coupling 54B. The coupling portion 57B has a substantially cylindrical shape that extends in the left-right direction. An outer diameter of the coupling portion 57B is smaller than the outer diameter of the coupling portion 57A of the first developing cartridge 11A.

Figure 9A:
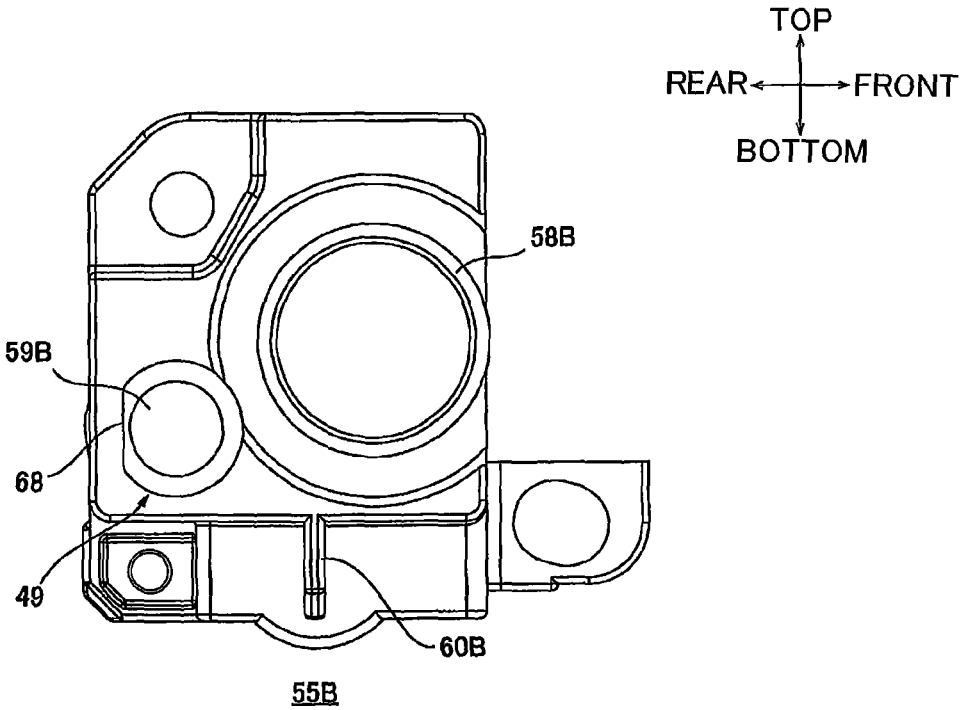
FIG. 9A is a left side view of a first cover in FIG. 7A.
Figure 9B:
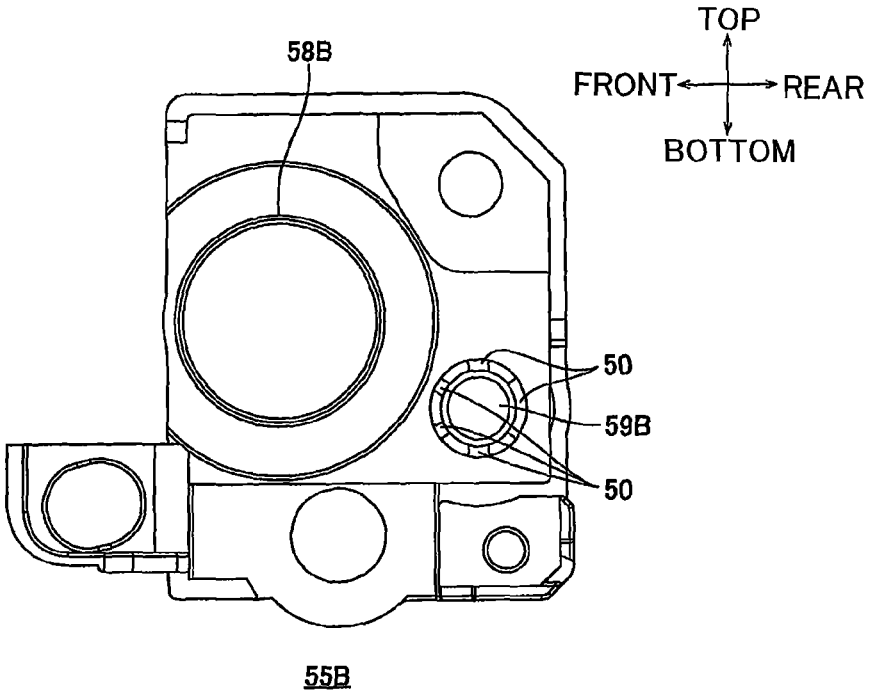
FIG. 9B is a right side view of the first cover in FIG. 7A.

As shown in FIGS. 7A, 9A, and 9B, the first cover 55B is configured in a similar manner to the first cover 55A of the first developing cartridge 11A, except that a shape of a coupling collar 58B, a shape of a developing roller shaft collar 59B as an example of a second cover member, and a position of a rib 60B are different from the shape of the coupling collar 58A, the shape of the developing roller shaft collar 59A and the position of the rib 60A of the first developing cartridge 11A.

The coupling collar 58B is disposed at a center portion of the first cover 55B. The coupling collar 58B has a substantially cylindrical shape that extends in the left-right direction. An inner diameter of the coupling collar 58B is substantially equal to the outer diameter of the coupling portion 57B of the developing coupling 54B. The inner diameter of the coupling collar 58B is smaller than the inner diameter of the coupling collar 58A of the first developing cartridge 11A. The coupling collar 58B is fitted with the coupling portion 57B of the developing coupling 54B.

The developing roller shaft collar 59B is disposed diagonally below and rearward of the coupling collar 58B. The developing roller shaft collar 59B has a substantially cylindrical shape that extends in the left-right direction and is closed on a left end thereof. The developing roller shaft collar 59B is fitted with the left end portion of the developing roller shaft 15A. The developing roller shaft collar 59B includes an enclosing portion 49 and a plurality of abutting portions 50 as an example of a contact portion.

The enclosing portion 49 constitutes an outer shape of the developing roller shaft collar 59B, and has a substantially cylindrical shape that extends in the left-right direction. A rear end 68 of the enclosing portion 49 is cut out in a manner extending linearly in the vertical direction. An outer diameter of the enclosing portion 49 is greater than the outer diameter of the developing roller shaft collar 59A of the first developing cartridge 11A, and substantially equal to the vertical inner dimension of the left collar receiving portion 37B of the second drum cartridge 10B. An inner diameter of the enclosing portion 49 is greater than the outer diameter of the left end portion of the developing roller shaft 15A.

The plurality of abutting portions 50 are arranged spaced at intervals along a circumferential direction of the enclosing portion 49. Each of the abutting portions 50 has a substantially rectangular shape in a side view, and projects inward in a radial direction of the enclosing portion 49 from an inner circumferential surface of the enclosing portion 49. A diameter of an imaginary circle that connects, in the circumferential direction, radially inner edges of the abutting portions 50 is substantially equal to the outer diameter of the left end portion of the developing roller shaft 15A.

The rib 60B is disposed at a substantially front-rear center portion of the first cover 55B and below a rear end portion of the coupling collar 58B. The rib 60B has a substantially flat plate shape that projects leftward from a left surface of the first cover 55B, and extends in the vertical direction.

Figure 10A:
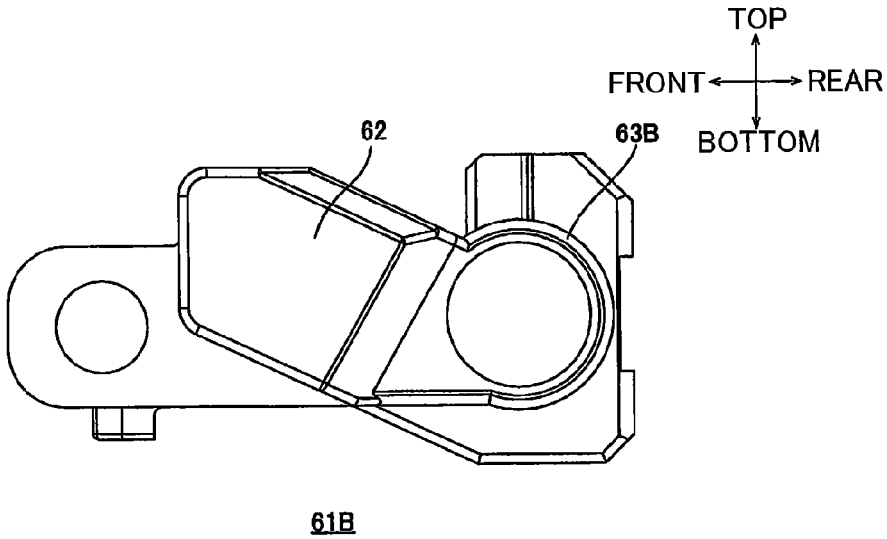
FIG. 10A is a right side view of a developing electrode in FIG. 7B.
Figure 10B:
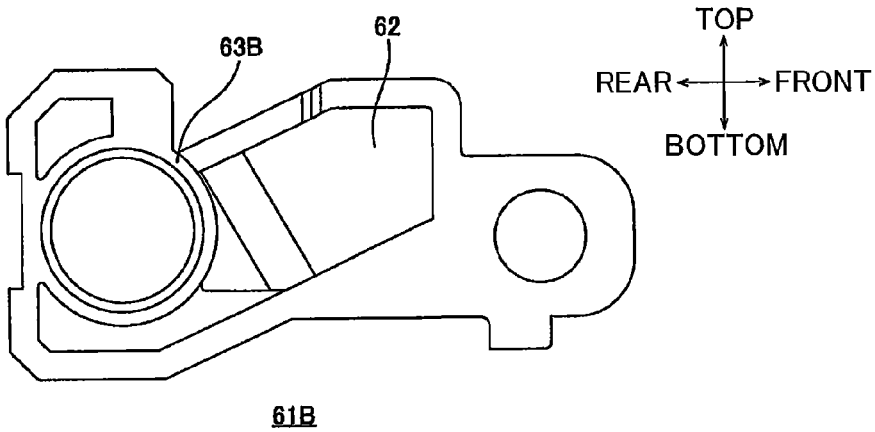
FIG. 10B is a left side view of the developing electrode in FIG. 10A.

As shown in FIGS. 7B, 10A, and 10B, the developing electrode 61B is configured in a similar manner to the developing electrode 61A of the first developing cartridge 11A, except that a shape of a developing roller shaft collar 63B as an example of a second cover member is different from the shape of the developing roller shaft collar 63A.

The developing roller shaft collar 63B is disposed at a rear half of the developing electrode 61B. The developing roller shaft collar 63B has a substantially cylindrical shape that extends in the left-right direction. An outer diameter of the developing roller shaft collar 63B is substantially equal to the outer diameter of the enclosing portion 49 of the developing roller shaft collar 59B. The outer diameter of the developing roller shaft collar 63B is smaller than the outer diameter of the enclosing portion 64 of the first developing cartridge 11A. The outer diameter of the developing roller shaft collar 63B is substantially equal to the vertical inner dimension of the right collar receiving portion 40B of the second drum cartridge 10B. An inner diameter of the developing roller shaft collar 63B is substantially equal to the outer diameter of the right end portion of the developing roller shaft 15A. The developing roller shaft collar 63B is fitted with the right end portion of the developing roller shaft 15A.

(3) Third Process Cartridge

Figure 11A:
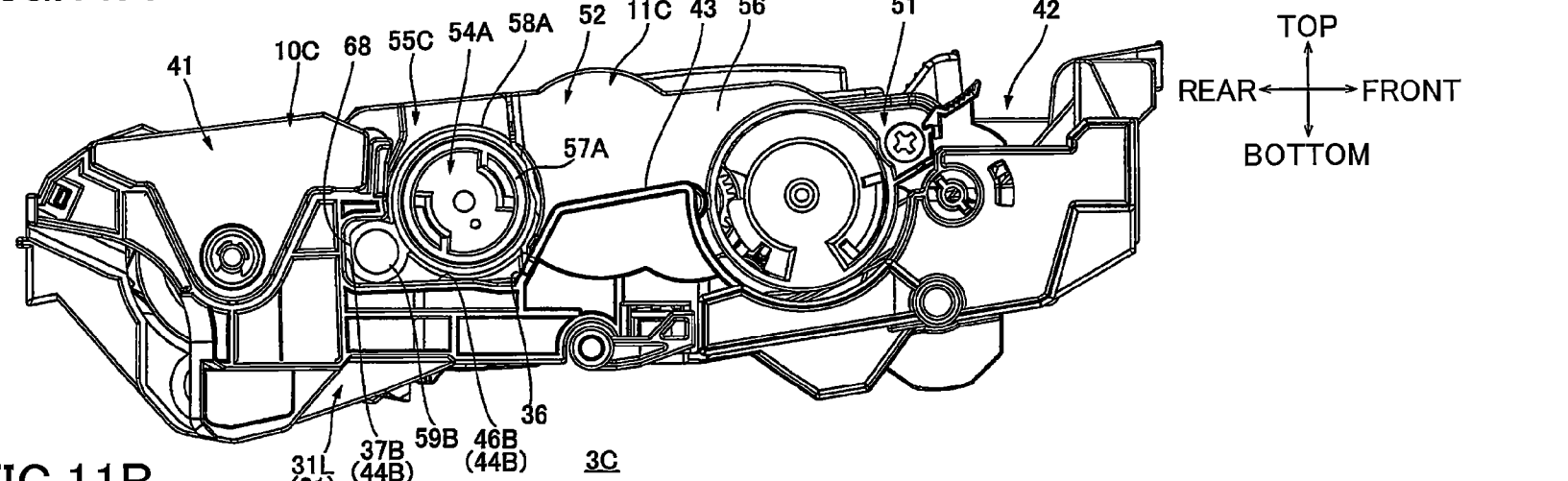
FIG. 11A is a left side view of a third process cartridge.
Figure 11B:
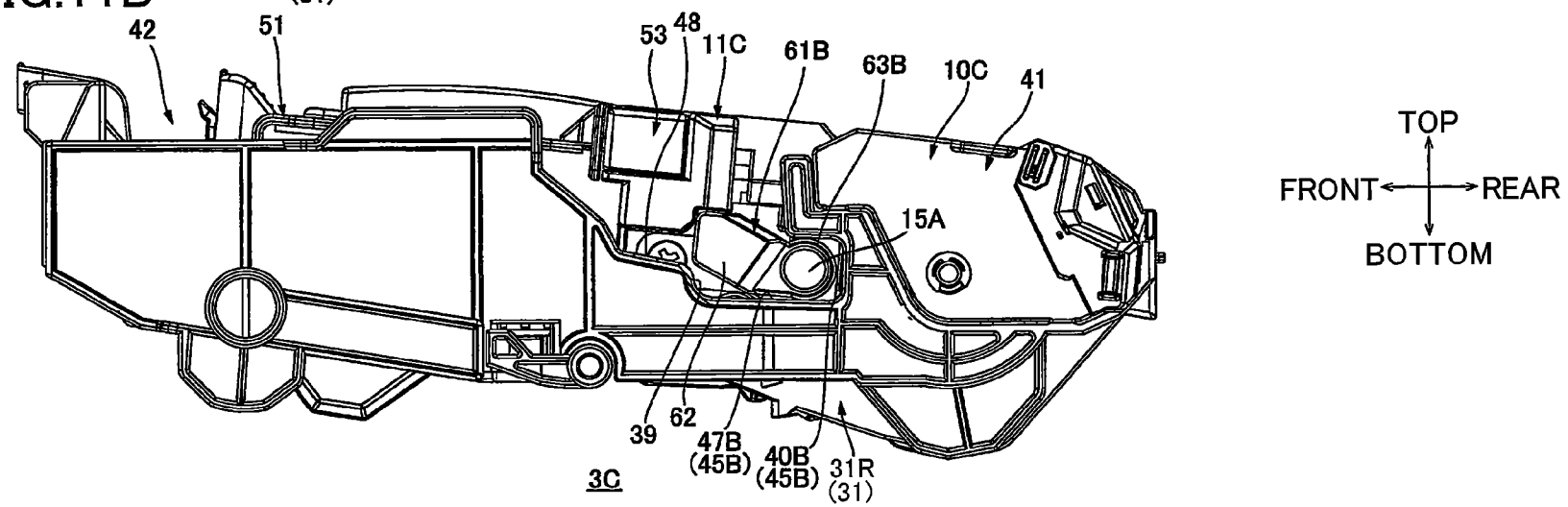
FIG. 11B is a right side view of the third process cartridge in FIG. 11A.

As shown in FIGS. 11A and 11B, a third process cartridge 3C includes a third drum cartridge 10C as an example of a second image carrier cartridge and a third developing cartridge 11C as an example of a second developing cartridge.

(3-1) Third Drum Cartridge

Figure 12:
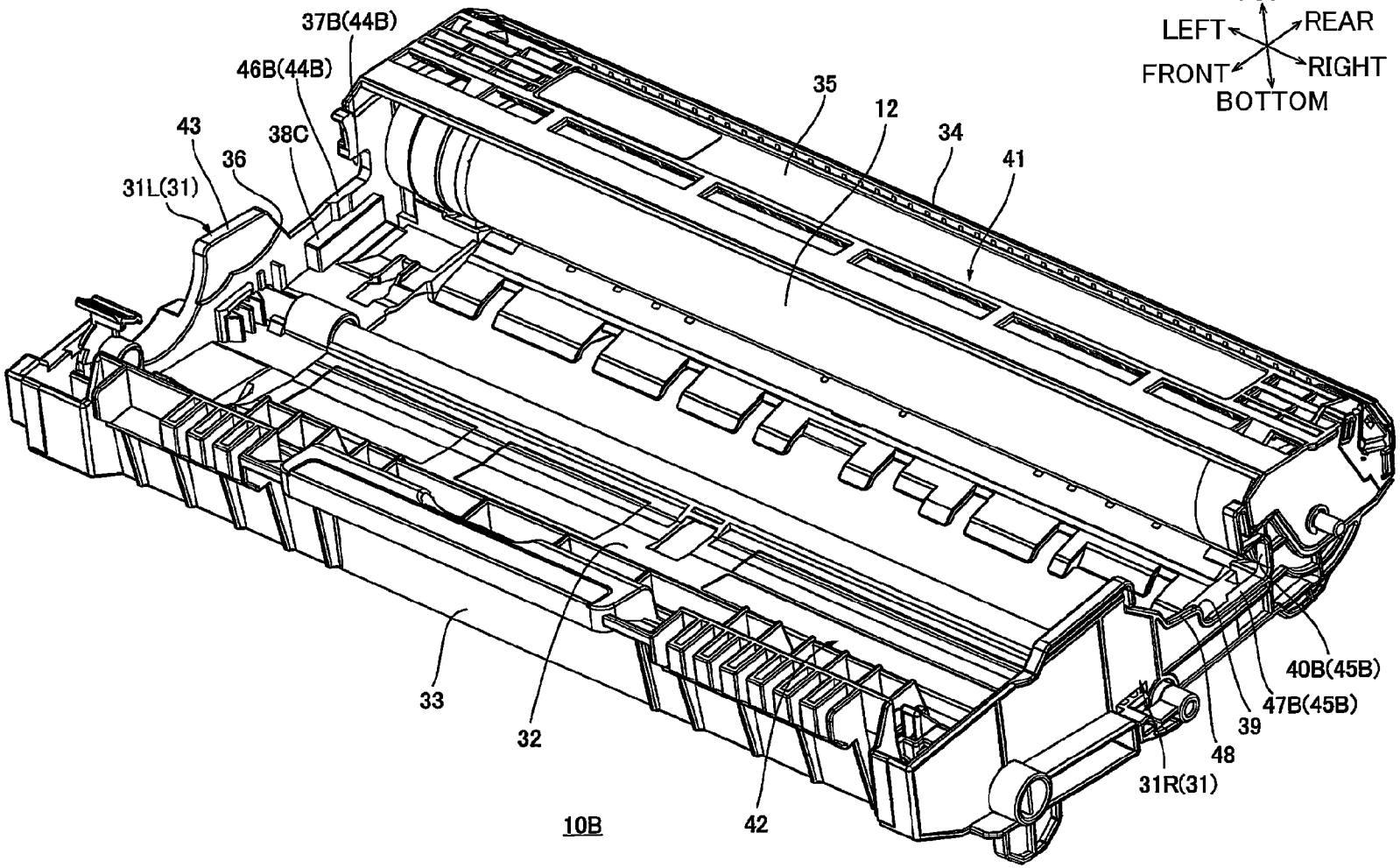
FIG. 12 is a perspective view of a third drum cartridge in FIG. 11A as viewed from an upper front side thereof.

As shown in FIG. 12, the third drum cartridge 10C is configured in a similar manner to the second drum cartridge 10B, except that the third drum cartridge 10C includes an interference portion 38C different from the interference portion 38B of the second drum cartridge 10B.

The interference portion 38C as an example of an interference portion is disposed below the first guide portion 44B. The interference portion 38C has a substantially prismatic shape that projects rightward from the right surface of the left side wall 31L. A front-rear length of the interference portion 38C is greater than the front-rear length of the interference portion 38A of the first drum cartridge 10A. A rear end of the interference portion 38C is positioned below the left collar receiving portion 37B. A front end of the interference portion 38B is positioned below the front edge of the first guide surface 46B.

(3-2) Third Developing Cartridge

As shown in FIGS. 11A and 11B, the third developing cartridge 11C is configured in a similar manner to the second developing cartridge 11B, except that the third developing cartridge 11C includes the developing coupling 54A the same as the developing coupling 54A of the first developing cartridge 11A and a first cover 55C different from the first cover 55B of the second developing cartridge 11B.

Figure 13A:
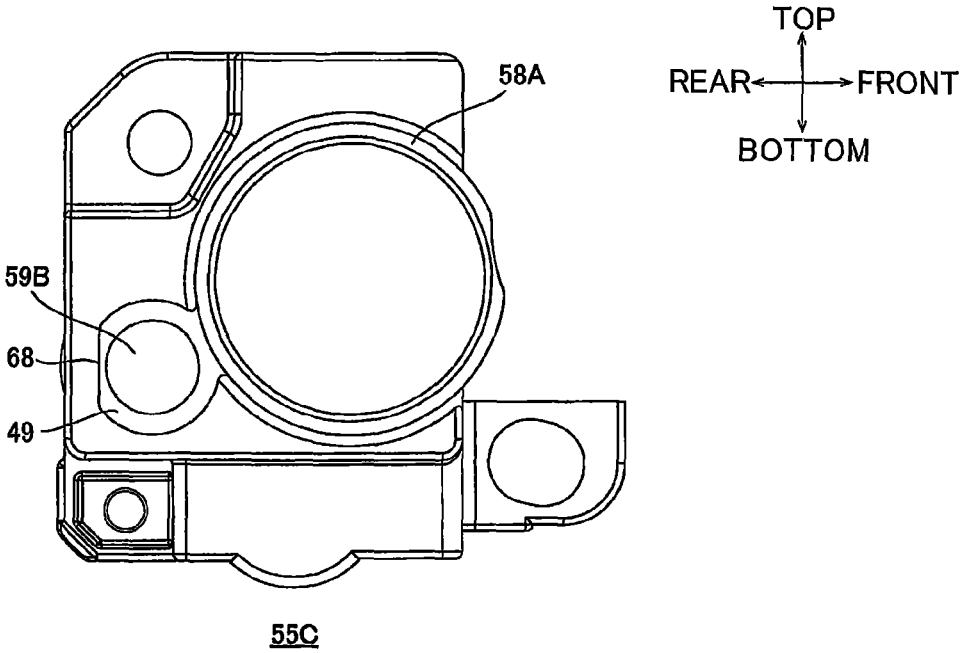
FIG. 13A is a left side view of a first cover in FIG. 11A.
Figure 13B:
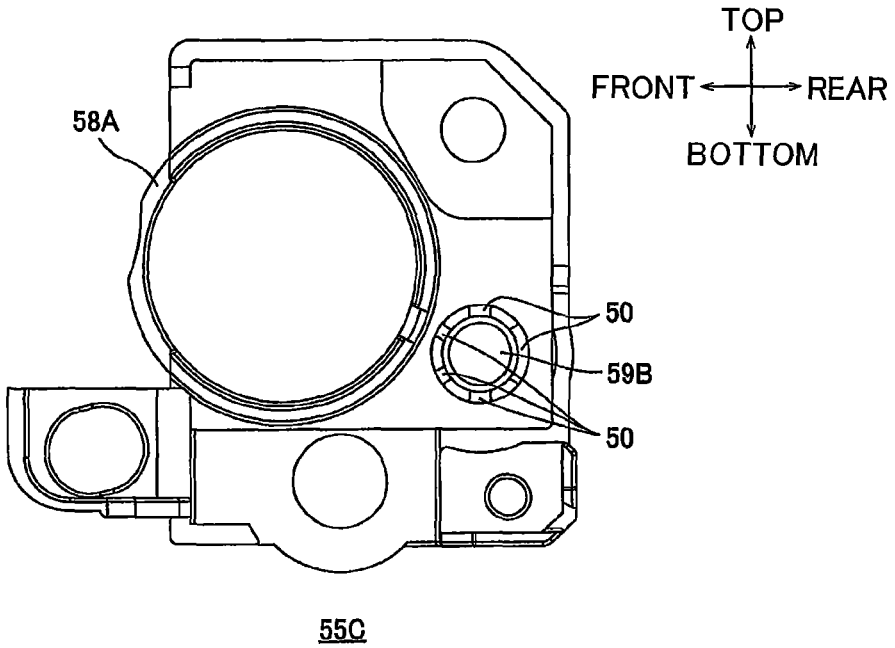
FIG. 13B is a right side view of the first cover in FIG. 13A.

As shown in FIGS. 11A, 13A, and 13B, the first cover 55C is configured in a similar manner to the first cover 55B of the second developing cartridge 11B, except that the first cover 55C includes the coupling collar 58A the same as the coupling collar 58A of the first developing cartridge 11A, and the developing roller shaft collar 59B the same as the developing roller shaft collar 59B of the second developing cartridge 11B, and does not include the rib 60B of the second developing cartridge 11B.

3. Identification of Gear Cover

When the plurality of types of the developing cartridges 11 described above are assembled, the first cover 55 of appropriate type among a plurality of types of the first covers 55 is attached to the developing frame 51 of the developing cartridge 11 of corresponding type. To avoid attaching of the first cover 55 of incorrect type to the drive portion 52 of the developing cartridge 11, whether or not the first cover 55 is of appropriate type needs to be checked. In view of the above, as shown in FIGS. 14A, 14B, and 14C, a plurality of types of jigs 71 corresponding to the plurality of types of the first covers 55 are used to increase efficiency of the checking operation of the first cover 55.

(1) Jig

The plurality of types of the jigs 71 include a first jig 71A corresponding to the first cover 55A of the first developing cartridge 11A, a second jig 71B corresponding to the first cover 55B of the second developing cartridge 11B, and a third jig 71C corresponding to the first cover 55C of the third developing cartridge 11C.

Figure 14A:
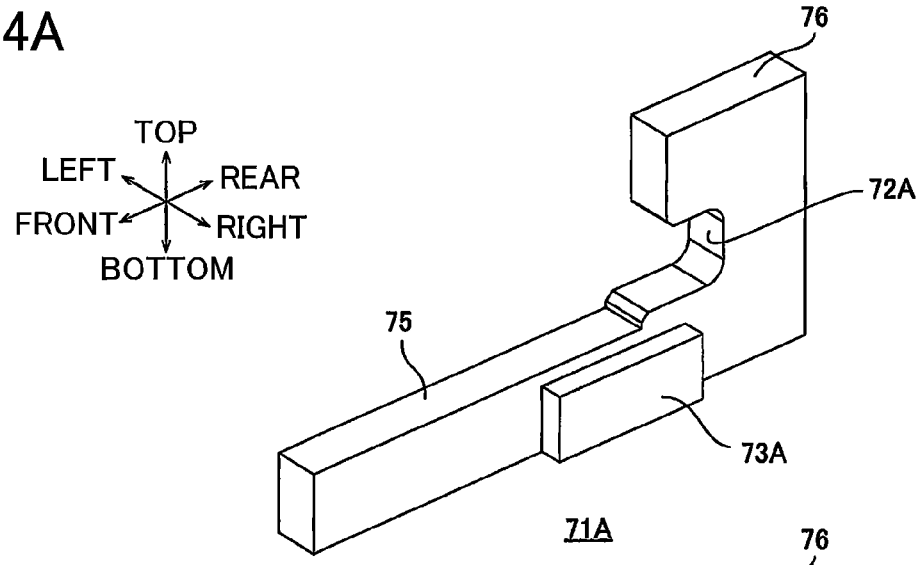
FIG. 14A is a perspective view of a first jig as viewed from a right front side thereof
Figure 14B:
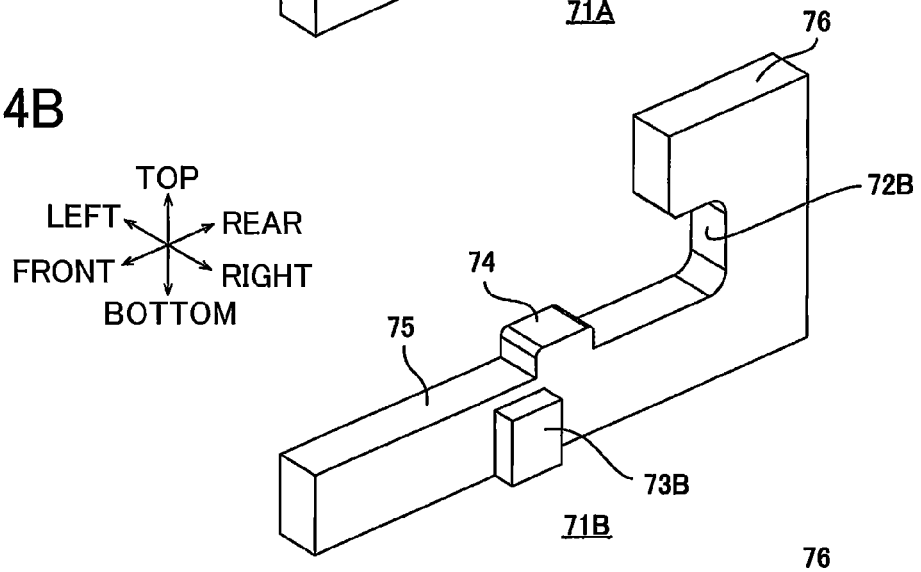
FIG. 14B is a perspective view of a second jig as viewed from a right front side thereof.
Figure 14C:
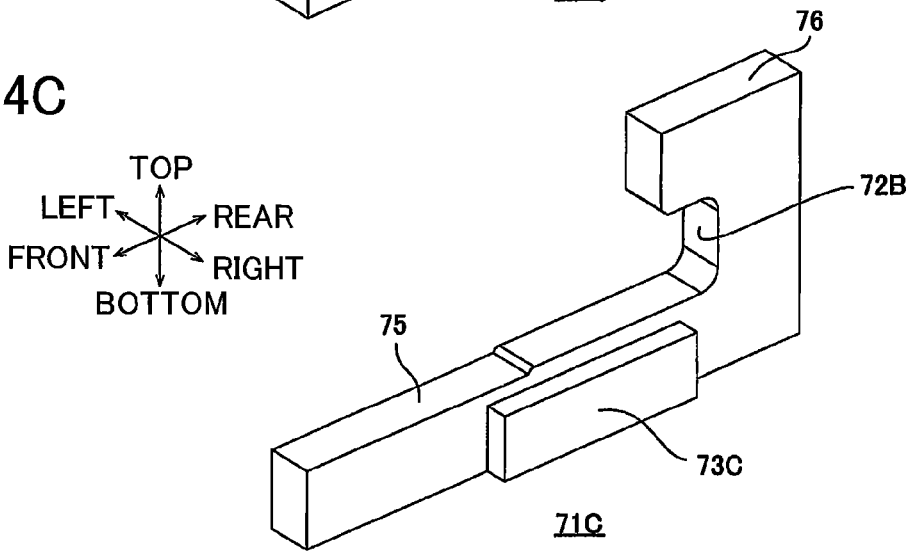
FIG. 14C is a perspective view of a third jig as viewed from a right front side thereof.

As shown in FIG. 14A, the first jig 71A has a flat plate shape that is substantially L-shaped in a side view. The first jig 71A includes a first portion 75, a second portion 76, a collar receiving portion 72A, and an interference portion 73A.

The first portion 75 has a substantially bar shape that extends in the front-rear direction.

The second portion 76 extends upward from a rear end portion of the first portion 75, and has a substantially rectangular flat plate shape in a side view.

The collar receiving portion 72A is disposed at a lower end portion of the second portion 76. The collar receiving portion 72A is recessed rearward from a front edge of the second portion 76. The collar receiving portion 72A has a shape the same as a shape of the left collar receiving portion 37A (see FIG. 3) of the first drum cartridge 10A.

The interference portion 73A is disposed at a substantial front-rear center portion of the first portion 75. The interference portion 73A projects rightward from a right surface of the first portion 75. The interference portion 73A has a shape the same as a shape of the interference portion 38A (see FIG. 3) of the first drum cartridge 10A. A rear end of the interference portion 73A is positioned below the collar receiving portion 72A.

As shown in FIG. 14B, the second jig 71B is configured in a similar manner to the first jig 71A, except that the second jig 71B includes a collar receiving portion 72B different from the collar receiving portion 72A of the first jig 71A, a coupling restriction portion 74, and an interference portion 73B different from the interference portion 73A of the first jig 71A.

The collar receiving portion 72B is disposed at a lower end portion of the second portion 76. The collar receiving portion 72B is recessed rearward from a front edge of the second portion 76. The collar receiving portion 72B has a shape the same as a shape of the left collar receiving portion 37B (see FIG. 8) of the second drum cartridge 10B.

The coupling restriction portion 74 has a substantially prismatic shape that extends upward from an upper edge of the first portion 75 at its substantial front-rear center portion so as to be abuttable against a lower edge of the coupling collar 58B of the second developing cartridge 11B.

The interference portion 73B is disposed at a substantial front-rear center portion of the first portion 75. The interference portion 73B projects rightward from the right surface of the first portion 75. The interference portion 73B has a shape the same as a shape of the interference portion 38B (see FIG. 8) of the second drum cartridge 10B. A rear end of the interference portion 73B is positioned below a front end of the coupling restriction portion 74.

As shown in FIG. 14C, the third jig 71C is configured in a similar manner to the second jig 71B, except that the third jig 71C does not include the coupling restriction portion 74 and includes an interference portion 73C different from the interference portion 73B of the second jig 71B.

The interference portion 73C is positioned at a substantial front-rear center portion of the first portion 75. The interference portion 73C projects rightward from the right surface of the first portion 75. The interference portion 73C has a shape the same as a shape of the interference portion 38C (see FIG. 12) of the third drum cartridge 10C. A rear end of the interference portion 73C is positioned below the collar receiving portion 72B.

(2) Identification Method

Next, operations for checking the types of the first covers 55 will be described.

As shown in FIG. 14A, the first jig 71A is provided in a manufacturing line for manufacturing the first developing cartridge 11A.

As shown in FIGS. 5A and 14A, an operator assembles the first cover 55A to the first jig 71A before assembling the first cover 55A to the developing frame 51 of the first developing cartridge 11A.

To assemble the first cover 55A to the first jig 71A, the first cover 55A is disposed rightward of the first jig 71A. At this time, the developing roller shaft collar 59A of the first cover 55A is fitted into the collar receiving portion 72A of the first jig 71A, and a lower edge of the coupling collar 58A of the first cover 55A is brought into contact with a top surface of the first portion 75 of the first jig 71A.

In this way, the operator confirms that the first cover 55 being checked is the first cover 55A for the first developing cartridge 11A.

As shown in FIGS. 9A, 13A, and 14A, there may be cases where the operator attempts to assemble the first cover 55 other than the first cover 55A for the first developing cartridge 11A to the first jig 71A when, for example, the first cover 55B for the second developing cartridge 11B or the first cover 55C for the third developing cartridge 11C is mixed in the manufacturing line for manufacturing the first developing cartridge 11A.

At this time, the outer diameter of the developing roller shaft collar 59B of the first cover 55B and the first cover 55C is greater than the outer diameter of the developing roller shaft collar 59A (see FIG. 5A) of the first cover 55A. Accordingly, the developing roller shaft collar 59B of the first cover 55B and the first cover 55C is not fitted into the collar receiving portion 72A of the first jig 71A.

In this way, the operator notices that the first cover 55 being checked is not the first cover 55A for the first developing cartridge 11A.

Similarly, as shown in FIG. 14B, the second jig 71B is provided in a manufacturing line for manufacturing the second developing cartridge 11B.

As shown in FIGS. 9A and 14B, an operator assembles the first cover 55B to the second jig 71B before assembling the first cover 55B to the developing frame 51 of the second developing cartridge 11B.

To assemble the first cover 55B to the second jig 71B, the first cover 55B is disposed rightward of the second jig 71B. At this time, the developing roller shaft collar 59B of the first cover 55B is fitted into the collar receiving portion 72B of the second jig 71B, and a lower edge of the coupling collar 58B of the first cover 55B is brought into contact with a top surface of the coupling restriction portion 74 of the second jig 71B.

In this way, the operator confirms that the first cover 55 being checked is the first cover 55B for the second developing cartridge 11B.

As shown in FIGS. 5A, 13A, and 14B, when the operator attempts to assemble the first cover 55 other than the first cover 55B for the second developing cartridge 11B to the second jig 71B, the outer diameter of the coupling collar 58A of the first cover 55A and the first cover 55C is greater than the outer diameter of the coupling collar 58B (FIG. 9A) of the first cover 55B. Accordingly, the coupling collar 58A of the first cover 55A and the first cover 55C interferes with the coupling restriction portion 74 of the second jig 71B, and the developing roller shaft collar 59A of the first cover 55A and the developing roller shaft collar 59B of the first cover 55C are not fitted into the collar receiving portion 72B of the second jig 71B.

In this way, the operator notices that the first cover 55 being checked is not the first cover 55B for the second developing cartridge 11B.

Similarly, as shown in FIG. 14C, the third jig 71C is provided in a manufacturing line for manufacturing the third developing cartridge 11C.

As shown in FIGS. 13A and 14C, an operator assembles the first cover 55C to the third jig 71C before assembling the first cover 55C to the developing frame 51 of the third developing cartridge 11C.

To assemble the first cover 55C to the third jig 71C, the first cover 55C is disposed rightward of the third jig 71C. At this time, the developing roller shaft collar 59B of the first cover 55C is fitted into the collar receiving portion 72B of the third jig 71C, and a lower edge of the coupling collar 58A of the first cover 55C is brought into contact with a top surface of the first portion 75 of the third jig 71C.

In this way, the operator confirms that the first cover 55 being checked is the first cover 55C for the third developing cartridge 11C.

As shown in FIGS. 5A, 9A, and 14C, when an operator attempts to assemble the first cover 55 other than the first cover 55C for the third developing cartridge 11C to the third jig 71C, the rib 60A of the first cover 55A and the rib 60B of the first cover 55B interfere with the interference portion 73C of the third jig 71C. Accordingly, the developing roller shaft collar 59A of the first cover 55A and the developing roller shaft collar 59B of the first cover 55B are not fitted into the collar receiving portion 72B of the third jig 71C.

In this way, the operator notices that the first cover 55 being checked is not the first cover 55C for the third developing cartridge 11C.

4. Mounting of Developing Cartridge in Drum Cartridge

Next, operations for mounting the developing cartridge 11 on the drum cartridge 10 will be described.

As shown in FIGS. 2A and 2B, an operator mounts the first developing cartridge 11A in the developing-cartridge accommodating portion 42 of the first drum cartridge 10A such that the developing roller shaft collar 59A is fitted into the left collar receiving portion 37A and the developing roller shaft collar 63A is fitted into the right collar receiving portion 40A.

Here, there may be a case where the operator attempts to assemble the developing cartridge 11 other than the first developing cartridge 11A to the first drum cartridge 10A in error.

At this time, as shown in FIGS. 2A, 7A, and 11A, the outer diameter of the developing roller shaft collar 59B of the second developing cartridge 11B and the third developing cartridge 11C is greater than the outer diameter of the developing roller shaft collar 59A of the first developing cartridge 11A. Accordingly, the developing roller shaft collar 59B of the second developing cartridge 11B and the third developing cartridge 11C abuts against a front end of the left collar receiving portion 37A of the first drum cartridge 10A, and is not fitted into the left collar receiving portion 37A of the first drum cartridge 10A.

In this way, the operator notices that the developing cartridge 11 being mounted in the first drum cartridge 10A is not the first developing cartridge 11A.

Similarly, there may be a case where an operator attempts to assemble the developing cartridge 11 other than the second developing cartridge 11B to the second drum cartridge 10B in error when the second developing cartridge 11B is to be assembled to the second drum cartridge 10B.

As shown in FIGS. 2B and 7B, when the operator attempts to assemble the first developing cartridge 11A to the second drum cartridge 10B, the outer diameter of the developing roller shaft collar 63A of the first developing cartridge 11A is greater than the outer diameter of the developing roller shaft collar 63B of the second developing cartridge 11B, and the rib 60A of the first developing cartridge 11A interferes with the interference portion 38B of the second drum cartridge 10B. Accordingly, the developing roller shaft collar 63A of the first developing cartridge 11A abuts against a front end of the right collar receiving portion 40B of the second drum cartridge 10B, and is not fitted into the right collar receiving portion 40B of the second drum cartridge 10B.

In this way, the operator notices that the developing cartridge 11 being assembled to the second drum cartridge 10B is not the second developing cartridge 11B.

Note that the third developing cartridge 11C is mountable in the second drum cartridge 10B.

However, as shown in FIGS. 7A and 11A, the outer diameter of the coupling portion 57A of the third developing cartridge 11C is greater than the outer diameter of the coupling portion 57B of the second developing cartridge 11B.

Hence, even if the second drum cartridge 10B to which the third developing cartridge 11C has been assembled is mounted in the main casing 2, the coupling (not shown) provided in the main casing 2 in which the second developing cartridge 11B is to be mounted cannot be coupled to the developing coupling 54A of the third developing cartridge 11C. That is, a driving force cannot be inputted to the third developing cartridge 11C from the main casing 2 in which the second developing cartridge 11B is to be mounted. As a result, the image-forming operation cannot be performed.

In this way, the operator notices that the developing cartridge 11 being assembled to the second drum cartridge 10B is not the second developing cartridge 11B.

There may also be a case where an operator attempts to assemble the developing cartridge 11 other than the third developing cartridge 11C to the third drum cartridge 10C in error when the third developing cartridge 11C is to be assembled to the third drum cartridge 10C.

As shown in FIGS. 2B and 11B, when the operator attempts to assemble the first developing cartridge 11A to the third drum cartridge 10C, the outer diameter of the developing roller shaft collar 63A of the first developing cartridge 11A is greater than the outer diameter of the developing roller shaft collar 63B of the third developing cartridge 11C, and the rib 60A of the first developing cartridge 11A also interferes with the interference portion 38C of the third drum cartridge 10C. Accordingly, the developing roller shaft collar 63A of the first developing cartridge 11A abuts against a front end of the right collar receiving portion 40B of the third drum cartridge 10C, and is not fitted into the right collar receiving portion 40B of the third drum cartridge 10C.

In this way, the operator notices that the developing cartridge 11 being assembled to the third drum cartridge 10C is not the third developing cartridge 11C.

As shown in FIGS. 9A and 12, when an operator attempts to assemble the second developing cartridge 11B to the third drum cartridge 10C, the rib 60B of the second developing cartridge 11B interferes with the interference portion 38C of the third drum cartridge 10C. Accordingly, the second developing cartridge 11B cannot be mounted in the third drum cartridge 10C.

In this way, the operator notices that the developing cartridge 11 being assembled to the third drum cartridge 10C is not the third developing cartridge 11C.

5. Operational Advantages (1) According to the above-described image forming system, as shown in FIGS. 2A, 7A, and 11A, mounting of the second developing cartridge 11B and the third developing cartridge 11C relative to the first drum cartridge 10A can be restricted by using the developing roller shaft collar 59B of the second developing cartridge 11B and the third developing cartridge 11C.

As a result, with a simple configuration, the operator can determine that the developing cartridge 11 to be mounted in the first drum cartridge 10A is not the first developing cartridge 11A when the developing cartridge 11 is to be mounted in the first drum cartridge 10A.

(2) According to the above-described image forming system, as shown in FIGS. 9A, 9B, 13A, and 13B, the developing roller shaft collar 59B of the second developing cartridge 11B and the third developing cartridge 11C includes the enclosing portion 49 that encloses the developing roller shaft 15A with a distance therefrom, and the abutting portions 50 that extend from the enclosing portion 49 toward the developing roller shaft 15A and contact the developing roller shaft 15A.

Hence, the developing roller shaft 15A can be covered with the enclosing portion 49 while a portion contacting the developing roller shaft 15A is reduced.

As a result, the developing roller shaft 15A can be protected while the developing roller shaft 15A is allowed to rotate smoothly.

(3) According to the above-described image forming system, as shown in FIGS. 2A, 7A, and 11A, an electric power can be supplied to the developing roller 15 by using the developing roller shaft collar 63A and the developing roller shaft collar 63B.

As a result, a configuration of the developing cartridge 11 can be simplified.

(4) According to the above-described image forming system, as shown in FIGS. 2A, 7A, and 11A, the outer diameter of the developing roller shaft collar 59B is greater than the vertical inner dimension of the left collar receiving portion 37A.

Hence, with a simple configuration, mounting of the second developing cartridge 11B or the third developing cartridge 11C relative to the first drum cartridge 10A can be reliably restricted.

(5) According to the above-described image forming system, as shown in FIGS. 5A, 8, and 12, the rib 60A of the first developing cartridge 11A interferes with the interference portion 38B of the second drum cartridge 10B and the interference portion 38C of the third drum cartridge 10C, so that mounting of the first developing cartridge 11A relative to the second drum cartridge 10B or the third drum cartridge 10C can be restricted.

(6) According to the above-described image forming system, as shown in FIGS. 2B, 7B, and 11B, mounting of the first developing cartridge 11A relative to the second drum cartridge 10B or the third drum cartridge 10C can be restricted by using the developing roller shaft collar 63A of the first developing cartridge 11A.

As a result, with a simple configuration, the operator can determine that the developing cartridge 11 to be mounted in the second drum cartridge 10B or the third drum cartridge 10C is not the second developing cartridge 11B or the third developing cartridge 11C when the developing cartridge 11 is to be mounted in the second drum cartridge 10B or the third drum cartridge 10C.

6. Modifications (1) First Modification

In the above-described embodiment, the first drum cartridge 10A is an example of the first image carrier cartridge, the first developing cartridge 11A is an example of the first developing cartridge, the second drum cartridge 10B or the third drum cartridge 10C is an example of the second image carrier cartridge, and the second developing cartridge 11B or the third developing cartridge 11C is an example of the second developing cartridge.

However, in a first modification, the second drum cartridge 10B or the third drum cartridge 10C is an example of the first image carrier cartridge, the second developing cartridge 11B or the third developing cartridge 11C is an example of the first developing cartridge, the first drum cartridge 10A is an example of the second image carrier cartridge, and the first developing cartridge 11A is an example of the second developing cartridge.

In this case, the right collar receiving portion 40B of the second drum cartridge 10B or the third drum cartridge 10C is an example of the first restriction portion and the first engaging portion, and the developing roller shaft collar 63A of the first developing cartridge 11A is an example of the second cover member.

According to the first modification, as shown in FIG. 6B, the abutting portions 65 vertically contact the developing roller shaft 15A.

Hence, the abutting portions 65 are not aligned in a contacting direction in which the developing roller 15 contacts the photosensitive drum 12. In other words, the abutting portions 65 are not disposed rearward of the developing roller shaft 15A. Accordingly, the developing roller 15 can reliably contact the photosensitive drum 12.

(2) Second Modification

In a second modification, the third drum cartridge 10C is an example of the first image carrier cartridge, the third developing cartridge 11C is an example of the first developing cartridge, the second drum cartridge 10B is an example of the second image carrier cartridge, and the second developing cartridge 11B is an example of the second developing cartridge.

At this time, the main casing 2 may include a first main casing 2 (not shown) in which the third drum cartridge 10C and the third developing cartridge 11C are mountable, and a second main casing 2 (not shown) in which the second drum cartridge 10B and the second developing cartridge 11B are mountable.

In this case, the developing coupling 54A of the third developing cartridge 11C is an example of the first receiving member, and the developing coupling 54B of the second developing cartridge 11B is an example of the second receiving member.

As shown in FIGS. 7A and 13A, and described in the embodiment, the outer diameter of the coupling portion 57A of the third developing cartridge 11C is greater than the outer diameter of the coupling portion 57B of the second developing cartridge 11B.

Hence, even if the second drum cartridge 10B to which the third developing cartridge 11C has been assembled is mounted in the main casing 2 in error, a coupling (not shown) provided in the second main casing 2 cannot be coupled to the developing coupling MA of the third developing cartridge 11C, and thus a driving force from the second main casing 2 is not inputted to the third developing cartridge 11C. As a result, the image-forming operation cannot be performed. The developing coupling MA of the third developing cartridge 11C is an example of an inhibiting portion.

In this manner, erroneous use of the third developing cartridge 11C in the second main casing 2 can be prevented.

(3) Other Modifications

In the above-described embodiment, the developing roller 15 is as an example of the developer carrier. Alternatively, for example, a magnetic roller or a brush roller may also be applied to the developer carrier.

In the above-described embodiment, the outer diameter of the developing roller shaft collar 59 covering the left end portion of the developing roller shaft 15A is formed to be greater than the vertical inner dimension of the left collar receiving portion 37 of the drum cartridge 10, and/or the outer diameter of the developing roller shaft collar 63 covering the right end portion of the developing roller shaft 15A is formed to be greater than the vertical inner dimension of the right collar receiving portion 40 of the drum cartridge 10. In this way, mounting of the developing cartridge 11 of different type in the drum cartridge 10 is prevented. However, mounting of the developing cartridge 11 of different type in the drum cartridge 10 can also be prevented in a similar manner to the above-described embodiment by using the left end portion and/or the right end portion of the developing roller shaft 15A itself.

Further, in place of the developing roller shaft collar 59 or the developing roller shaft collar 63, a member capable of fitting into the left collar receiving portion 37 or the right collar receiving portion 40 of the drum cartridge 10 may be provided on an axis of the developing roller shaft 15A. By using this member, the developing cartridge 11 of different type can be prevented from being mounted in the drum cartridge 10, in a manner similar to the above-described embodiment.

Further, in place of the developing roller shaft collar 59 or the developing roller shaft collar 63, a boss or the like projecting from the developing frame 51 so as not to overlap the axis of the developing roller shaft 15A can also be used to prevent the developing cartridge 11 of different type from being mounted in the drum cartridge 10, in a manner similar to the above-described embodiment.

In the above-described embodiment, the drum cartridges 10A, 10B, and 10C may not necessarily be provided with the interference portions 38A, 38B, and 38C, respectively.

While the present invention has been described in detail with reference to the embodiment thereof, it would be apparent to those skilled in the art that various changes and modifications may be made therein without departing from the spirit of the present invention.

What is claimed is:

1. An image forming system comprising:

a main casing of an image forming apparatus;

a plurality of types of developing cartridges comprising:

a first developing cartridge including:

a first developer carrier configured to carry a developer thereon and having a first end portion; and a first cover member configured to cover the first end portion; and a second developing cartridge different in type from the first developing cartridge, the second developing cartridge including:

a second developer carrier configured to carry a developer thereon and having a second end portion; and a second cover member configured to cover the second end portion, the second cover member being different from the first cover member; and a plurality of types of image carrier cartridges each configured to accommodate a selected one of the plurality of types of developing cartridges, the plurality of types of image carrier cartridges comprising:

a first image carrier cartridge including:

a first image carrier configured to carry an electrostatic latent image thereon;

a first cartridge accommodating portion configured to accommodate the first developing cartridge;

a first engaging portion configured to engage the first cover member; and a first restriction portion; and a second image carrier cartridge different in type from the first image carrier cartridge, the second image carrier cartridge including:

a second image carrier configured to carry an electrostatic latent image thereon;

a second cartridge accommodating portion configured to accommodate the second developing cartridge; and a second engaging portion configured to engage the second cover member, the first restriction portion being configured to restrict the second cover member from engaging the first engaging portion.

2. The image forming system as claimed in claim 1, wherein the first developer carrier includes a first rotation shaft to provide the first end portion covered by the first cover member, and wherein the second developer carrier includes a second rotation shaft to provide the second end portion covered by the second cover member.

3. The image forming system as claimed in claim 2, wherein the second cover member includes:

an enclosing portion enclosing the second rotation shaft with a distance from the second rotation shaft; and a contact portion extending from the enclosing portion toward the second rotation shaft and contacting the second rotation shaft.

4. The image forming system as claimed in claim 3, wherein the second developer carrier is configured to contact the second image carrier in a contacting direction, and wherein the contact portion contacts the second rotation shaft in a direction perpendicular to the contacting direction.

5. The image forming system as claimed in claim 1, wherein the first cover member is configured to supply the first developer carrier with an electric power from the main casing, and wherein the second cover member is configured to supply the second developer carrier with an electric power from the main casing.

6. The image forming system as claimed in claim 1, wherein the first cover member is configured to be fitted within the first engaging portion, and wherein the second cover member is configured to be fitted within the second engaging portion, the second cover member having an outer dimension greater than an inner dimension of the first engaging portion.

7. The image forming system as claimed in claim 1, wherein the main casing includes a plurality of types of main casings, the plurality of types of main casings comprising:

a first main casing in which the first developing cartridge is detachably mountable; and a second main casing different in type from the first main casing and in which the second developing cartridge is detachably mountable, wherein the first developing cartridge further includes a first receiving member configured to receive a first driving force supplied from the first main casing, the second developing cartridge further including a second receiving member configured to receive a second driving force supplied from the second main casing, the first receiving member including an inhibiting portion configured to inhibit the second driving force from being inputted into the first developing cartridge.

8. The image forming system as claimed in claim 1, wherein the first developing cartridge further includes a projecting portion projecting outward, and wherein the second image carrier cartridge further includes an interference portion configured to abut against the projecting portion to restrict the first developing cartridge from being mounted in the second image carrier cartridge.

9. The image forming system as claimed in claim 1, wherein the first developer carrier is elongated in an elongating direction, the first end portion including a first one end portion on one side in the elongating direction and a first another end portion on another side opposite to the one side in the elongating direction, the first cover member comprising a first end cover member configured to cover the first one end portion and a second end cover member configured to cover the first another end portion, wherein the second developing carrier is elongated in the elongating direction, the second end portion including a second one end portion on the one side in the elongating direction and a second another end portion on the another side in the elongating direction, the second cover member comprising a third end cover member configured to cover the second one end portion and a fourth end cover member configured to cover the second another end portion, wherein the first image carrier cartridge has a first cartridge end on the one side in the elongating direction and includes the first restriction portion at the first cartridge end, the first restriction portion being configured to restrict the third end cover member from engaging the first engaging portion, and wherein the second image carrier cartridge has a second cartridge end on the another side in the elongating direction and includes a second restriction portion at the second cartridge end, the second restriction portion being configured to restrict the second end cover member from engaging the second engaging portion.

10. The image forming system as claimed in claim 1, wherein the first cover member has a cylindrical configuration, the first engaging portion and the first restriction portion in combination providing a recessed configuration to allow the first cover member to be fitted thereinto.

* * * * *